US006522062B2

(12) United States Patent
Ogawa et al.

(10) Patent No.: US 6,522,062 B2
(45) Date of Patent: Feb. 18, 2003

(54) FLUORESCENT DISPLAY DEVICE AND METHOD FOR DRIVING SAME

(75) Inventors: Yukio Ogawa, Mobara (JP); Kazuyoshi Ishikawa, Mobara (JP); Katsutoshi Kougo, Mobara (JP); Hiroaki Kawasaki, Mobara (JP)

(73) Assignee: Futaba Corporation, Mobara (JP)

( * ) Notice: Subject to any disclaimer, the term of this patent is extended or adjusted under 35 U.S.C. 154(b) by 54 days.

(21) Appl. No.: 09/776,689

(22) Filed: Feb. 6, 2001

(65) Prior Publication Data

US 2001/0013755 A1 Aug. 16, 2001

(30) Foreign Application Priority Data

Feb. 10, 2000 (JP) ..... 2000-033385
Mar. 22, 2000 (JP) ..... 2000-079237
Apr. 20, 2000 (JP) ..... 2000-118827

(51) Int. Cl.[7] ..... H01J 1/62
(52) U.S. Cl. ..... 313/496; 315/169.3; 345/75.1
(58) Field of Search ..... 313/495, 496, 313/497, 278, 302, 303, 304; 315/169.1, 169.3; 345/47, 75.1

(56) References Cited

U.S. PATENT DOCUMENTS 5,426,342 A 6/1995 Nakamura et al.
5,541,478 A * 7/1996 Troxell et al. ..... 313/495
5,614,786 A 3/1997 Nakamura et al.
5,708,450 A 1/1998 Kawasaki et al.
5,808,590 A 9/1998 Kawasaki et al.

FOREIGN PATENT DOCUMENTS

JP 2-291598 A * 12/1990

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A fluorescent display device of the plane grid type capable of reducing accumulation of charges on an insulating layer, to thereby prevent an electron shading phenomenon and permit electrons emitted from a filament toward anode electrodes to be uniformly spread in a plane-like manner on both sides of the filament. A first substrate is formed thereon with stripe-like thin-film anode electrodes and stripe-like thin-film grids in a matrix-like manner through a thin-film insulating layer. The insulating layer and grids are formed with openings. Phosphors are deposited on portions of the anode electrodes exposed through the openings. The grids are formed into a height equal to or smaller than that of the phosphors. A second substrate is formed thereon with back electrodes for controlling emission of electrons from filaments. Control voltages applied to the back electrodes have a potential gradient given thereto so that a potential difference occurs between a position near the filaments and a position apart therefrom.

21 Claims, 22 Drawing Sheets

FLUORESCENT DISPLAY DEVICE AND METHOD FOR DRIVING SAME

BACKGROUND OF THE INVENTION

This invention relates to a fluorescent display device, and more particularly to a graphic-type vacuum fluorescent display (VFD) and a method for driving the same.

A conventional fluorescent display device will be described with reference to FIGS. 22(*a*) and 22(*b*) each showing a conventional anode substrate. The anode substrate shown in FIG. 22(*a*) and that shown in FIG. 22(*b*) are different in structure of openings from each other. In each of FIGS. 22(*a*) and 22(*b*), reference character S1 designates an anode-side glass substrate which has a plurality of anode electrodes A1 formed thereon. The anode electrodes A1 have an insulating layer D deposited all thereover. The insulating layer D is formed thereon with grids G2 to G3. The anode electrodes A1 and grids G2 to G3 are arranged in a manner to be laminated on each other. The grids G2 to G3 and insulating layer D are formed with openings of either a rectangular or square shape or a circular shape. The openings have phosphors H1 to H2 arranged therein in a manner to be positioned on portions of the anode electrodes exposed through the openings, respectively. The grids G2 and G3, phosphors H1 and H2 and insulating layer D are made by thick film screen printing.

In the structure shown in FIG. 22(*a*), the phosphor H1 and insulating layer D are formed into the same height. Whereas, in FIG. 22(*b*), the phosphor H1 is formed into a height smaller than the insulating layer D. Above the grids G2 and G3 are arranged filaments (not shown) in a manner to be positioned on a side opposite to the anode electrodes. Such arrangement is disclosed in Japanese Utility Model Application Laid-Open Publication No. 69354/1988.

The grids function to draw out electrons emitted from the filaments toward the anode electrodes, so that it is required to arrange the grids in proximity to the filaments rather than the anode electrodes. In each of the structures shown in FIGS. 22(*a*) and 22(*b*), the grids G2 and G3 are formed into a height larger than the phosphors H1 and H2, to thereby be positioned in proximity to the filaments. Thus, in the structure of FIG. 22(*a*), a part of electrons emitted from the filaments toward the anode electrodes A1 is struck against an exposed surface Ds1 of the insulating layer D, leading to accumulation of electrons or charges. Also, in FIG. 22(*b*), the electrons are partially struck against an exposed surface Ds2 of the insulating layer D, leading to the accumulation.

In the structure shown in each of FIGS. 22(*a*) and 22(*b*), the charges thus accumulated on the insulating layer cause a so-called electron eclipsing or shading phenomenon of repelling electrons traveling toward an end of the phosphor H1, so that the electrons fail to reach the end. This results in the end of the phosphor H1 having a portion which fails to emit light. This is true of the phosphor H2 as well. Affection of such an electron shading phenomenon is increased as a width of the anode electrodes and/or grids is reduced and an interval therebetween is reduced. More specifically, the affection is increased as definition is increased, resulting in a deterioration in quality of display.

Also, in the conventional fluorescent display device, the grids G2 and G3 and insulating layer D each are made of a thick film. In this regard, a thickness of the insulating layer D is generally restricted to a level as large as about 0.2 mm or more. Thus, formation of such a thick film into the insulating layer D leads to a failure in an increase in definition.

Further, in the conventional fluorescent display device, the filaments are stretchedly arranged so as to be spaced from each other at predetermined intervals, to thereby cause the anode electrodes positioned in proximity to the filaments and those away therefrom to be different in the amount of electrons traveling thereto, leading to a difference in luminescence between the anode electrodes or non-uniformity in luminance.

SUMMARY OF THE INVENTION

The present invention has been made in view of the foregoing disadvantage of the prior art.

Accordingly, it is an object of the present invention to provide a fluorescent display device which is capable of minimizing non-uniformity in luminance, to thereby exhibit increased definition.

It is another object of the present invention to provide a fluorescent display device which is capable of reducing accumulation of charges on an insulating layer.

It is a further object of the present invention to provide a fluorescent display device which is capable of permitting electrons emitted from filaments to be uniformly spread or diffused in a plane-like manner.

In accordance with one aspect of the present invention, a fluorescent display device is provided. The fluorescent display device includes a first substrate, on which stripe-like phosphor-deposited anode electrodes and stripe-like grids are arranged in a matrix-like manner through an insulating layer. The anode electrodes, grids and insulating layer each are made of a thin film. The fluorescent display device also includes a second substrate, back electrodes each made of a thin film and arranged on the second substrate, and filaments stretchedly arranged between the first substrate and the second substrate.

In accordance with this aspect of the present invention, a fluorescent display device is provided. The fluorescent display device includes a first substrate, stripe-like anode electrodes and stripe-like grids arranged in a matrix-like manner on the first substrate through an insulating layer. The anode electrodes each have a phosphor deposited thereon. The anode electrodes, grids and insulating layer each are made of a thin film. The fluorescent display device also includes a second substrate, back electrodes each made of a thin film and arranged on the second substrate, and filaments stretchedly arranged between the first substrate and the second substrate. The grids and insulating layer are formed at portions thereof positioned at intersections between the anode electrodes and the grids with openings, and the phosphor is deposited on a portion of the anode electrodes exposed through each of the openings.

Also, in accordance with this aspect of the present invention, a fluorescent display device is provided. The fluorescent display device includes a first substrate, stripe-like phosphor-deposited anode electrodes and stripe-like grids arranged in a matrix-like manner on the first substrate through an insulating layer, a second substrate, stripe-like back electrodes each arranged on the second substrate, and filaments stretchedly arranged between the first substrate and the second substrate so as to extend in a longitudinal direction of the back electrodes.

Further, in accordance with this aspect of the present invention, a fluorescent display device is provided. The fluorescent display device includes a first substrate and stripe-like anode electrodes and stripe-like grids arranged in a matrix-like manner on the first substrate through an insulating layer. The anode electrodes each have a phosphor deposited thereon. The fluorescent display device also includes a second substrate, stripe-like back electrodes arranged on the second substrate, and filaments stretchedly arranged between the first substrate and the second substrate so as to extend in a longitudinal direction of the back electrodes. The grids and insulating layer are formed at portions thereof positioned at intersections between the anode electrodes and the grids with openings. The phosphors each are deposited on a portion of the anode electrodes exposed through each of the openings.

In a preferred embodiment of the present invention, the fluorescent display device further includes a means for giving a potential gradient to filament selection voltages applied to the back electrodes.

In a preferred embodiment of the present invention, the phosphors each have a surface arranged in proximity to the filaments as compared with a surface of the grids contiguous to the insulating layer.

In a preferred embodiment of the present invention, the opening of each of the grids is formed with a cutout.

In a preferred embodiment of the present invention, the first substrate is formed with recesses for receiving at least the phosphors therein, respectively. The recesses of the first substrate each may be formed on an inner surface thereof with a tapered portion. Also, the insulating layer and grids may be formed with recesses each of which overlies an inner surface of each of the recesses of the first substrate. The recesses of said grids each may be formed on an inner surface thereof with a tapered portion. The first substrate may be so formed that a surface thereof opposite to a surface thereof formed with the recesses is rough.

In accordance with another object of the present invention, a method for driving the fluorescent display device constructed as described above. In the method, the back electrodes are classified into filament control groups. The filament control groups have filament selection voltages and filament non-selection voltages applied thereto by time division, to thereby select the filament which is permitted to emit electrons. The filament selection voltages may have a potential gradient given thereto.

In a preferred embodiment of the present invention, the method includes a step of applying filament section voltages and filament non-selection voltages to the filaments by time division, to thereby select the filament which is permitted to emit electrons.

In a preferred embodiment of the present invention, the methods further includes the steps of applying filament section voltages and filament non-selection voltages to the filaments by time division, to thereby select the filament which is permitted to emit electrons and applying control voltages having a potential gradient given thereto to the back electrodes.

In a preferred embodiment of the present invention, the method further includes the step of applying grid selection voltages to the grids by time division by time division. Each adjacent two of the grids may have grid selection voltages concurrently applied thereto.

In a preferred embodiment of the present invention, the method further includes the step of applying grid selection voltages to the grids and inputting a data signal to the anode electrodes, to thereby select the phosphor which is permitted to emit light.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 1(*b*) is a fragmentary sectional view of the fluorescent display device shown in FIGS. 1(*a*) and 1(*b*);

FIG. 2(*b*) is a fragmentary enlarged sectional view of the fluorescent display device shown in FIGS. 1(*a*) and 1(*b*);

FIG. 10(*b*) is a fragmentary plan view of the fluorescent display device shown in FIG. 10(*a*);

FIG. 12(*b*) is a fragmentary plan view of the fluorescent display device of FIG. 12(*a*), which likewise shows the manner of application of control voltages to back electrodes in the fluorescent display device;

FIG. 13(*b*) is a fragmentary plan view of the fluorescent display device of FIG. 13(*a*), which likewise shows the manner of application of the filament selection voltages;

FIG. 17(*b*) is a fragmentary plan view of the fluorescent display device of FIG. 17(*a*), which likewise shows the manner of application pf control voltages to back electrodes;

FIG. 19(*b*) is a plan view of the fluorescent display device of FIG. 19(*a*), which likewise shows the manner of application of the filament selection voltages;

DETAILED DESCRIPTION OF THE PREFERRED EMBODIMENTS

Now, the present invention will be described with reference to FIGS. 1(*a*) to 21(*b*).

Figure 1A:
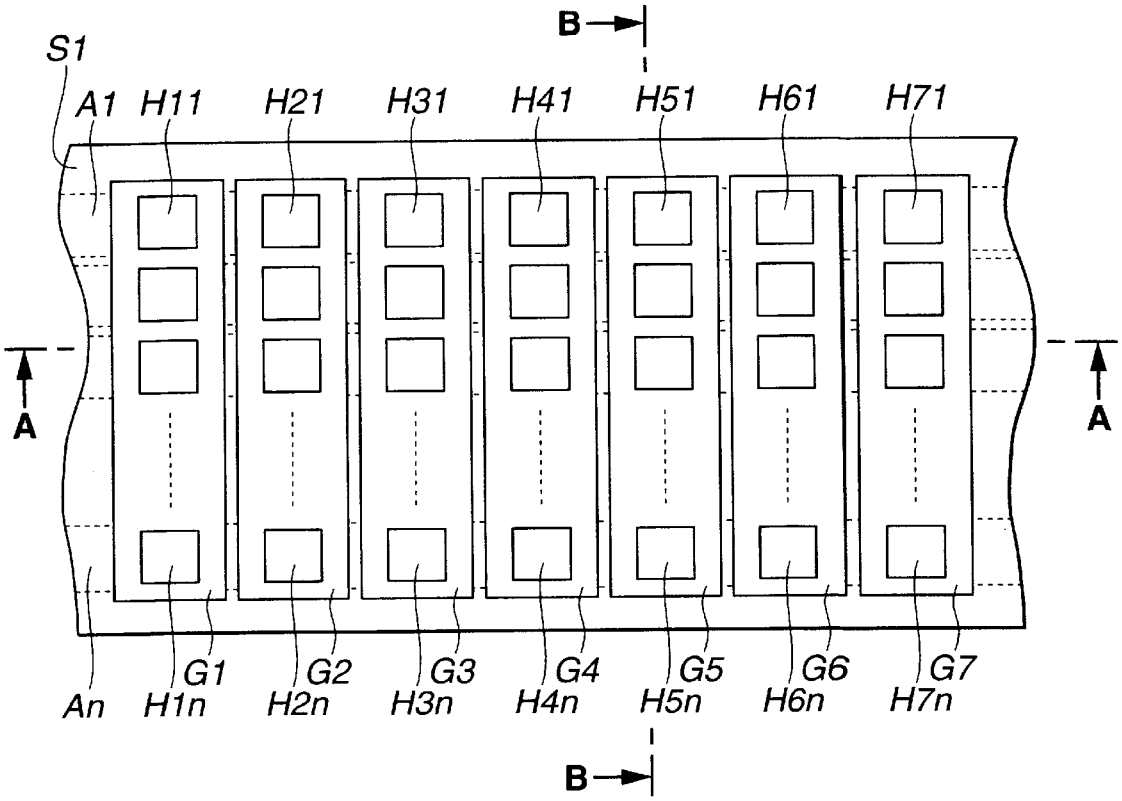
FIG. 1(*a*) is a fragmentary plan view showing a first embodiment of a fluorescent display device according to the present invention.
Figure 1B:
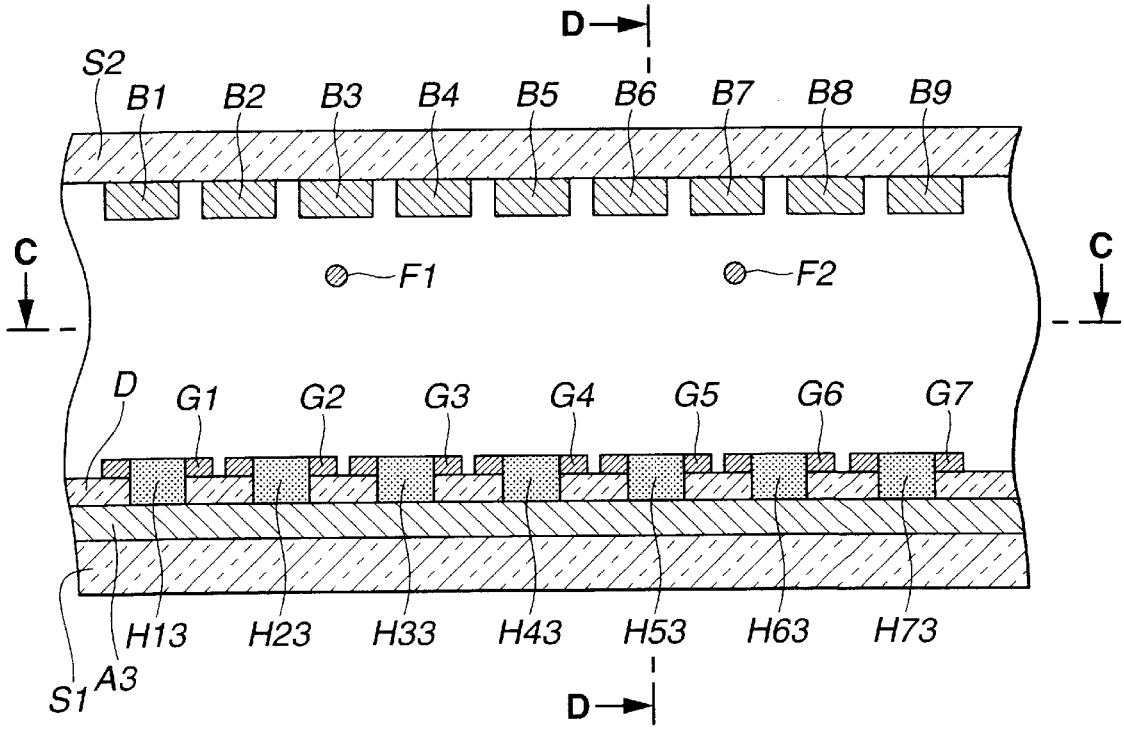
Figure 2A:
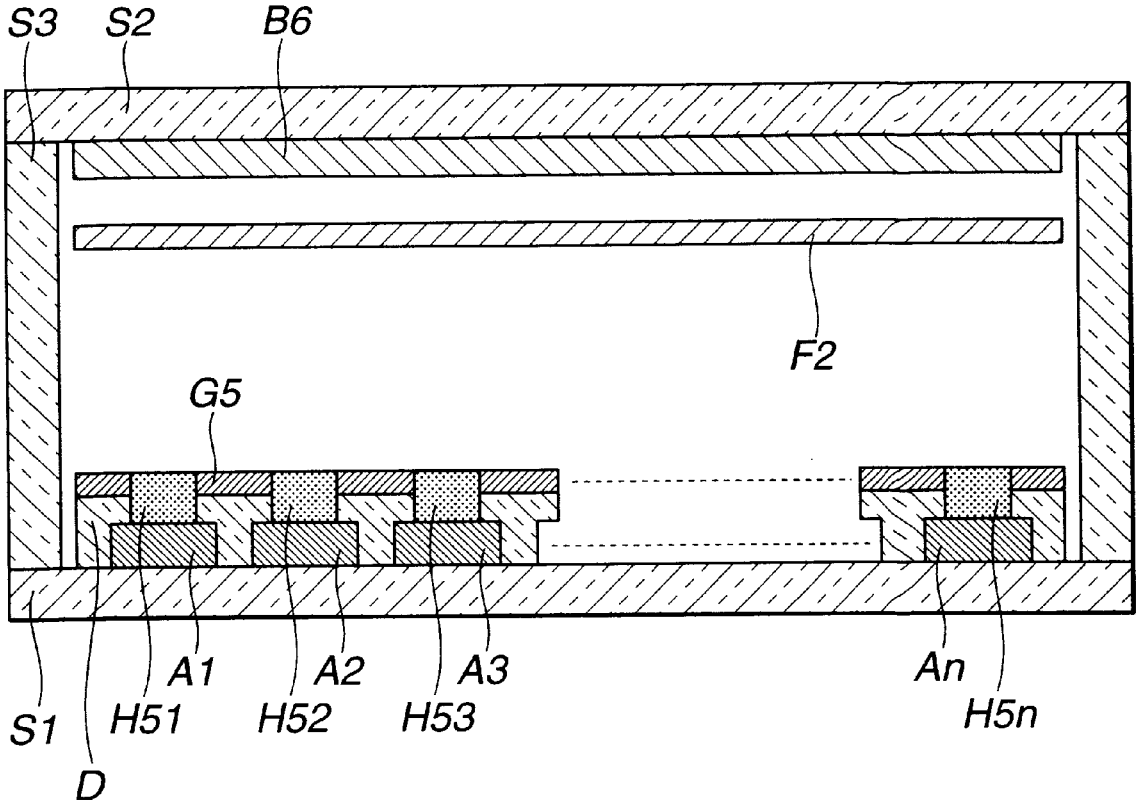
FIG. 2(*a*) is a sectional view of the fluorescent display device shown in FIGS. 1(*a*) and 1(*b*)
Figure 2B:
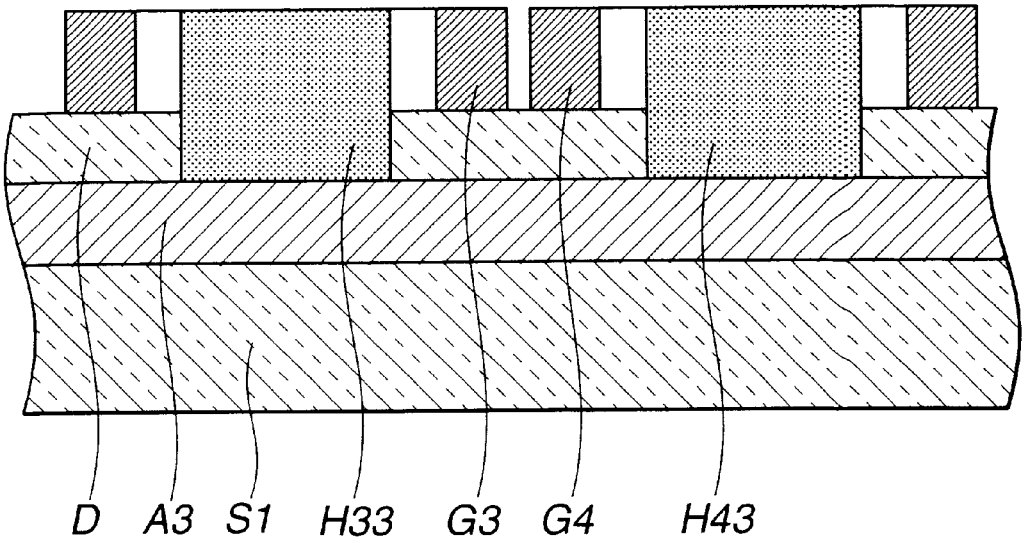
Figure 3A:
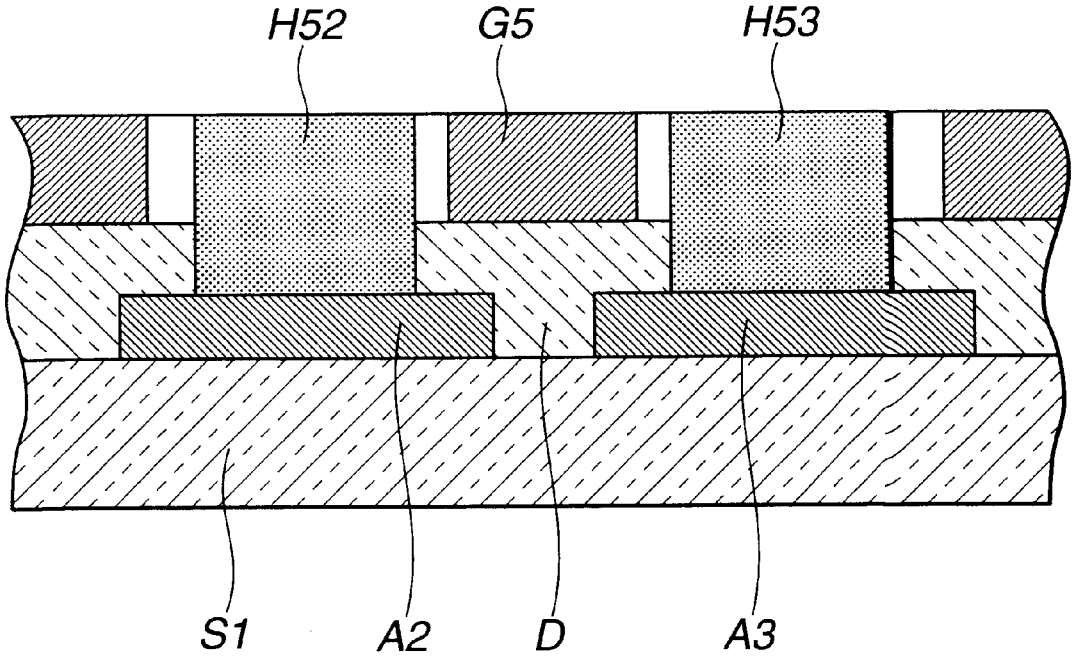
FIGS. 3(*a*) and 3(*b*) each are a fragmentary enlarged sectional view of the fluorescent display device shown in FIGS. 1(*a*) and 1(*b*)
Figure 3B:
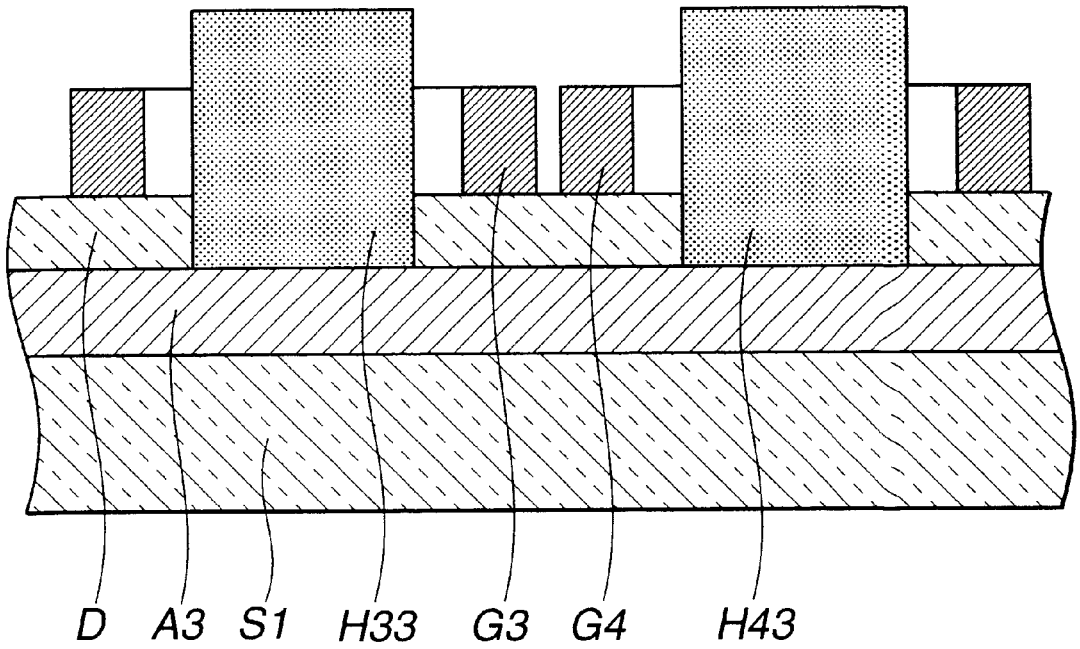

Referring first to FIGS. 1(*a*) to 3(*b*), a first embodiment of a flourescent display device according to the present invention is illustrated, wherein FIG. 1(*a*) is a plan view of a first substrate of the fluorescent display device taken along line C—C in FIG. 1(*b*), FIG. 1(*b*) is a sectional view taken along line A—A of FIG. 1(*a*) showing filaments not shown in FIG. 1(*a*) and a second substrate, FIG. 2(*a*) is a sectional view taken along line D—D of FIG. 1(*b*), FIG. 2(*b*) is an enlarged view showing the first substrate, FIG. 3(*a*) is an enlarged view showing the first substrate shown in FIG. 2(*a*), and FIG. 3(*b*) shows a modification of the first substrate.

In FIGS. 1(*a*) to 3(*b*), reference character S1 designates a first substrate made of glass, A1 to An each are an anode electrode made of a thin film, H11 to H1n, . . . , H71 to H7n each are a phosphor, D is an insulating layer made of a thin film, G1 to G7 each are a stripe-like grid made of a thin film and formed with an opening, F1 and F2 each are a filament, B1 to B9 each are a stripe-like back electrode, S2 is a second substrate made of glass, and S3 is a side plate made of glass.

The anode electrodes A1 to An and grids G1 to G7 are arranged in a matrix-like manner through the insulating layer D so as to intersect each other. The grids G1 to G7 and insulating layer D are formed at each of portions thereof positioned at intersections between the anode electrodes and the grids with an opening. The anode electrodes A1 to An have phosphors H11 to H7n deposited on portions thereof which are exposed through the openings. The filaments F1 and F2 are stretchedly arranged so as to extend in a longitudinal direction of the stripe-like back electrodes B1 to B9.

The anode electrodes A1 to An are formed into a width of 125 $\mu$m and are arranged so as to be spaced from each other at intervals of 125 $\mu$m. The filaments F1 and F2 are formed into a diameter of 15 $\mu$m. The filaments and anode electrodes are arranged so as to be spaced from each other at intervals of about 1.0 mm.

The openings of the grids G1 to G7 and insulating layer D each may be formed in such a manner as shown in FIG. 2(*b*) or 3(*a*). In FIG. 2(*b*), the phosphors H33 and H43 and grid G3 and G4 are formed into substantially the same height. Also, in FIG. 3(*a*) as well, the phosphors H52 and H53 and grid G5 are formed into substantially the same height. Such formation of the phosphors and grids into substantially the same height permits electrons emitted from the filaments to be concentrated on the phosphors, to thereby reduce accumulation of electrons or charges on the insulating layer D, leading to a reduction in electron eclipsing or shading phenomenon.

In FIG. 3(*b*), the phosphors H33 and H43 are formed into a height larger than that of the grids G3 and G4, to thereby be positioned in proximity to the filaments as compared with the grids. Such configuration permits electrons emitted from the filaments to be further concentrated on the phosphors H33 and H43, to thereby further reduce accumulation of electrons or charges on the insulating layer D.

In the illustrated embodiment, the insulating layer D is made of a thin film, so that a thickness of the insulating layer D may be reduced to a level one tenth as large as the conventional insulating layer made of a thick film or less. This further enhances a reduction in accumulation of electrons or charges on the insulating layer D.

In the illustrated embodiment, the openings of the insulating layer and therefore a configuration of the phosphors may be formed into a substantially square or rectangular shape, as shown in FIGS. 1(*a*) to 3(*b*). Alternatively, they may be formed into any other suitable configuration such as, for example, a polygonal shape, a circular shape or the like.

The insulating layer D shown in FIGS. 1(*a*) to 3(*b*) is constructed so as to exhibit a black matrix function as well. Thus, the illustrated embodiment eliminates a necessity of arranging a black matrix separately.

Also, the fluorescent display device of the illustrated embodiment includes the back electrodes B1 to B9 which are never seen in the conventional fluorescent display device. The back electrodes B1 to B9 function to help a function of the grids G1 to G7, even when grids are formed into a height substantially identical with or smaller than that of the phosphors H11 to H7n. Thus, the back electrodes B1 to B9 and grids G1 to G7 cooperate with each other to positively control electrons emitted from the filaments F1 and F2 toward the anode electrodes A1 to An.

The openings of the grids G1 to G7 incorporated in the fluorescent display device of the illustrated embodiment will be described with reference to FIGS. 4(*a*) to 5(*b*). In these figures, the insulating layer D is omitted for the sake of brevity, therefore, only grids G and anode electrodes A are shown.

Figure 4A:
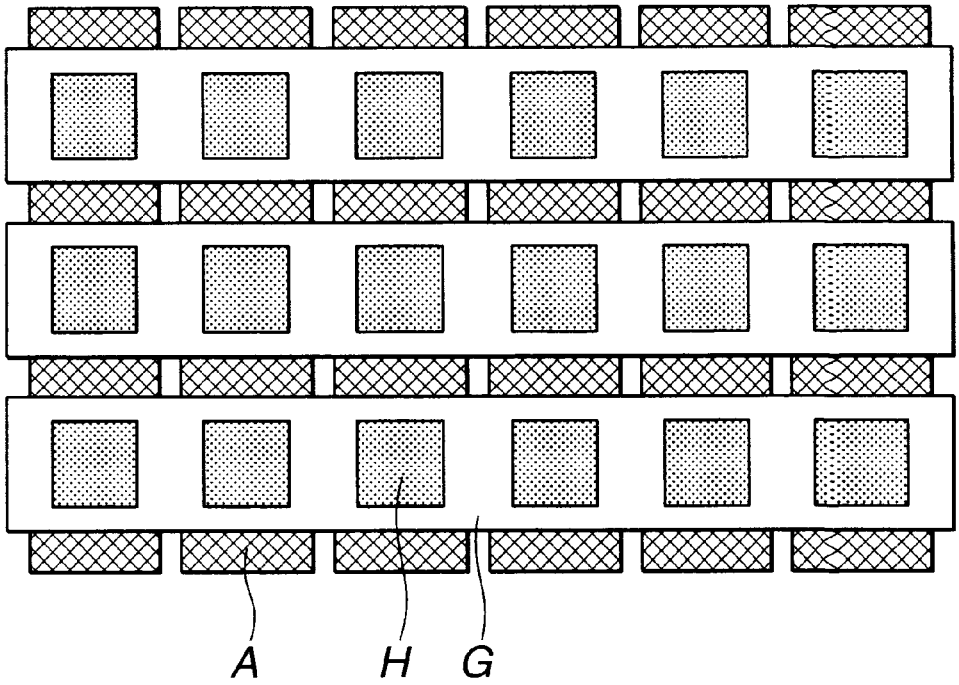
FIGS. 4(*a*) and 4(*b*) each are a schematic view showing openings of grids incorporated in the fluorescent display device shown in FIGS. 1(*a*) and 1(*b*)
Figure 4B:
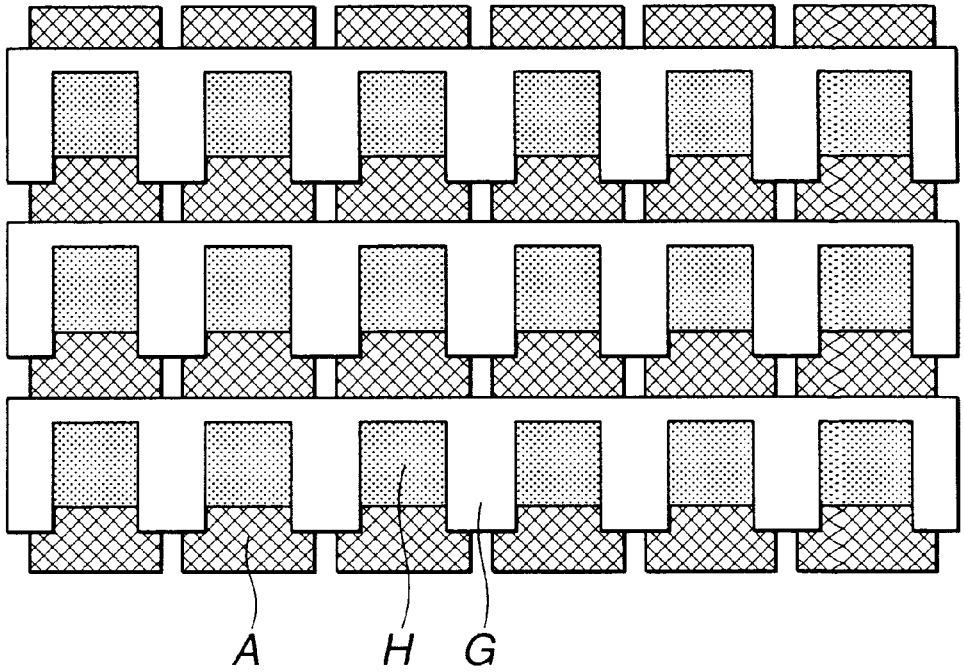

In FIG. 4(*a*), the openings of grids G each are arranged so as to fully surround the phosphor H; whereas in FIG. 4(*b*), the openings each are cut away on predetermined one of sides thereof, so that the openings are arranged in a pectinate manner.

Figure 5A:
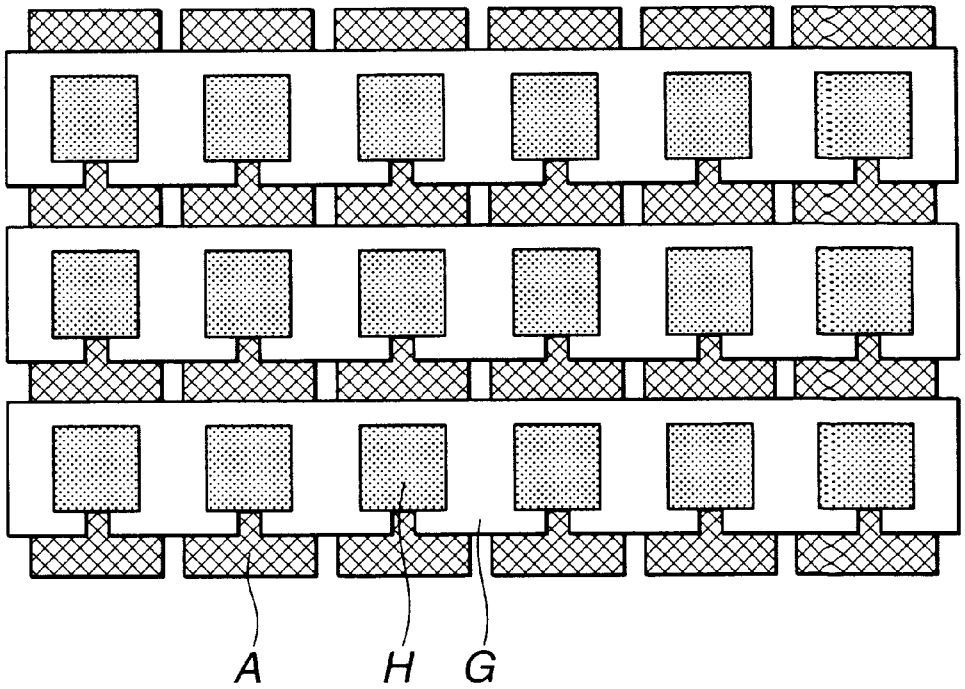
FIGS. 5(*a*) and 5(*b*) each are a schematic view showing a modification of openings of grids incorporated in the fluorescent display device shown in FIGS. 1(*a*) and 1(*b*)
Figure 5B:
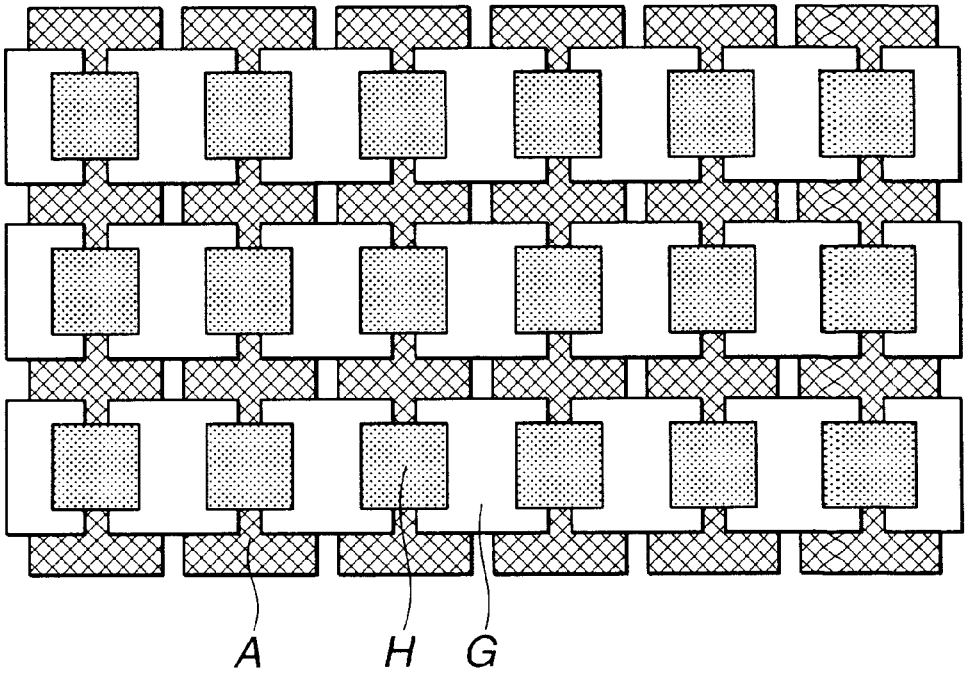

In FIG. 5(*a*), each of the openings of the grids is cut away at one portion thereof, whereas in FIG. 5(*b*), it is cut away at two portions thereof.

Thus, in each of FIGS. 4(*b*), 5(*a*) and 5(*b*), the opening of the grid is partially cut away, to thereby permit a mask for formation of the openings to be formed with bridges. This results in the openings being formed by mask deposition as described hereinafter.

Now, manufacturing of the fluorescent display device of the illustrated embodiment will be described. First of all, the first glass substrate S1 is formed thereon with the thin film-like anode electrodes A1 to An by forming a film of metal such as indium tin oxide (ITO), Al or the like by sputtering, EB deposition or the like. Then, it is subjected to chemical etching, so that the anode electrodes A1 to An may be patterned into a predetermined shape. Alternatively, the patterning may be carried out concurrently with formation of the metal films by means of a deposition mask. The anode electrodes are formed into a thickness of between tens of nanometers and thousands of nanometers. The thickness may be suitably selected within the above-described range in view of resistivity of metal used for the anode electrodes, a wiring pattern thereof and the like. A material for the anode electrodes may be selected from the group consisting of ITO, Al and the like when the fluorescent display device is the direct observation type that luminescence of the phosphors is observed through the second substrate S2. Alternatively, it may be ITO when the fluorescent display device is the permeation type (FL type) that the luminescence is observed through the first substrate S1.

Then, the anode electrodes A1 to An are subjected to chemical vapor deposition (CVD) of silicon oxide (SiOx), silicon nitride (SiN) or the like, to thereby be formed thereon with the thin-film insulating layer D. Then, the insulating layer D is subjected to chemical etching, RIE dry etching or the like, to thereby be formed with the openings, resulting in the anode electrodes being partially exposed. The insulating layer D is formed into a thickness within a range of between hundreds of nanometers and thousands of nanometers.

The insulating layer D is subjected to sputtering, EB deposition or the like using metal such as ITO, A1 or the like, resulting in being formed thereon with the thin-film grids G1 to G7, which are then subjected to dry etching or the like, to thereby be formed with the openings. A thickness of the grids is set to be within a range of between tens of nanometers and thousands of nanometers. At this time, the openings shown in FIG. 4(*a*) are formed by photolithography after formation of the grids G1 to G7. The openings of FIGS. 4(*b*), 5(*a*) and 5(*b*) are partially cut away, so that a mask for formation of the openings may be provided with bridges. This permits the openings of FIGS. 4(*b*), 5(*a*) and 5(*b*) to be formed by mask deposition concurrently with formation of the grids G1 to G7. Portions of the anode electrodes exposed through the openings of FIGS. 4(*a*), 4(*b*), 5(*a*) and 5(*b*) are formed thereon with film-like phosphors H11 to H7n by slurry techniques. The phosphors are formed into a thickness of between hundreds of nanometers and ten thousand nanometers.

Subsequently, the second glass substrate S2 is formed thereon with the thin-film back electrodes B1 to B9 according to substantially the same procedure as that for formation of the anode electrodes A1 to An.

Lastly, the first substrate S1 and second substrate S2 are arranged so as to face each other and then the filaments F1 and F2 are arranged therebetween. The filaments F1 and F2 may be made of tungsten (W) or the like. Then, both substrates S1 and S2 and the side plate S3 are sealedly joined to each other by means of a sealing material, to thereby form an envelope, which is then evacuated at a vacuum, resulting in the fluorescent display device being obtained.

Figure 6:
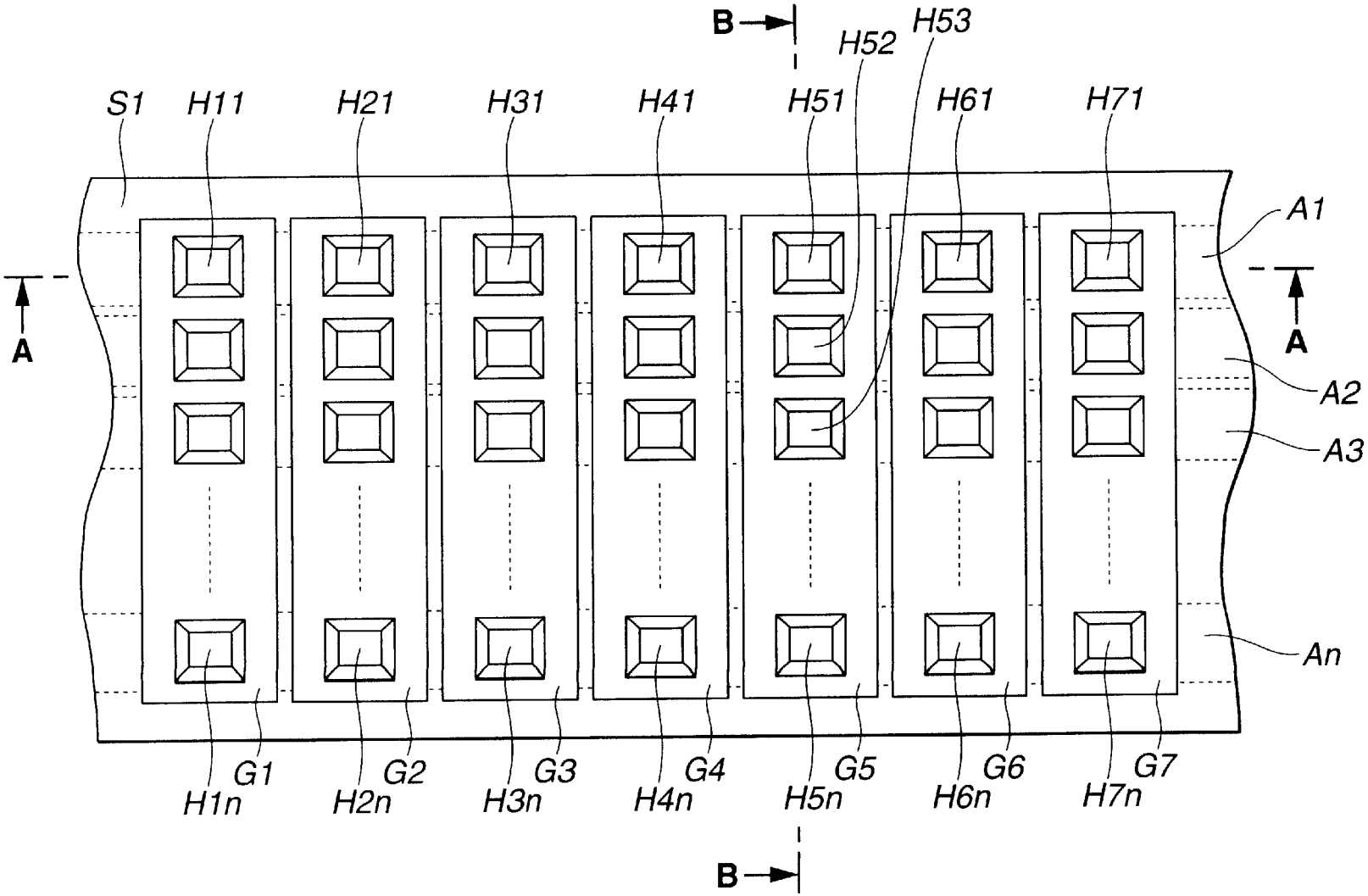
FIG. 6 is a fragmentary plan view showing a first substrate incorporated in a second embodiment of a fluorescent display device according to the present invention.
Figure 7A:
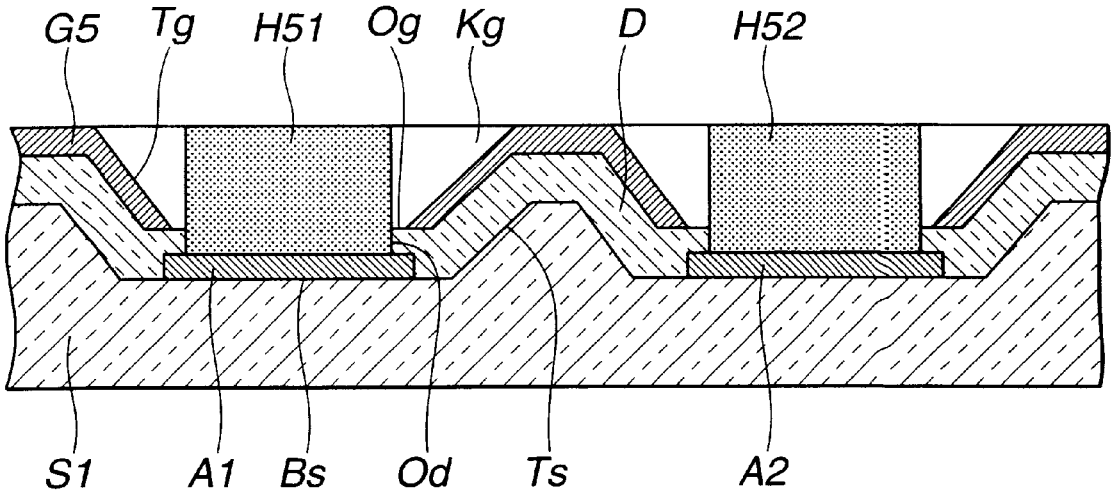
FIGS. 7(*a*) and 7(*b*) each are a fragmentary sectional view of the first substrate shown in FIG. 6.
Figure 7B:
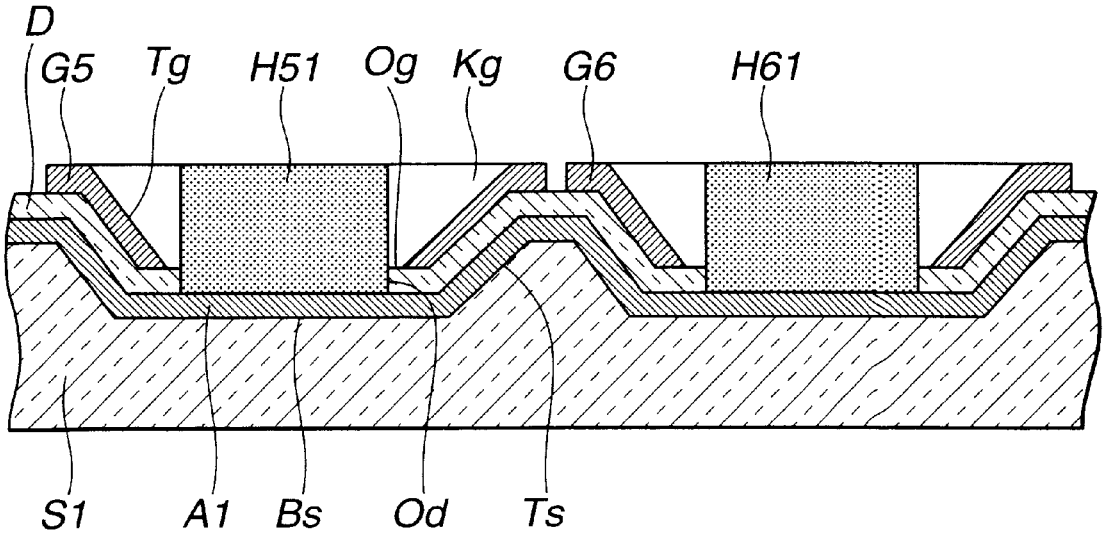

Referring now to FIGS. 6 to 7(*a*), a second embodiment of a fluorescent display device according to the present invention is illustrated, wherein FIG. 6 is a plan view of a first substrate, FIG. 7(*a*) is an enlarged sectional view taken along line B—B of FIG. 6 and FIG. 7(*b*) is an enlarged sectional view taken along line A—A of FIG. 6.

In FIG. 6, reference character S1 designates a first substrate S1 made of glass, A1 to An each are a stripe-like thin-film anode electrode, H11 to H1, . . . , H71 to H7n each are a phosphor, G1 to G7 each are a stripe-like thin-film grid, which is provided on a bottom thereof with a recess formed with an opening. The anode electrodes A1 to An and grids G1 to Gn are arranged in a matrix-like manner so as to intersect each other. The anode electrodes A1 to An have the phosphors H11 to H7n deposited on portions thereof positioned at intersections between the anode electrodes A1 to An and the grids G1 to Gn. The anode electrodes A1 to An are formed into a width of 125 $\mu$m and arranged so as to be spaced from each other at intervals of 125 $\mu$m.

The first substrate S1, anode electrodes A1 to An, grids G1 to G7, insulating layer D and phosphors H11 to H7n will be described in detail with reference to FIGS. 7(*a*) and 7(*b*). In FIGS. 7(*a*) and 7(*b*), the anode electrodes and the like are shown at only a part thereof for the sake of brevity.

The first substrate S1 is formed at portions thereof positionally corresponding to the phosphors H51, H52 and H61 with recesses. The recessed each include a tapered portion Ts and a bottom portion Bs. The anode electrode A1, as shown in FIG. 7(*b*), is formed in a stripe-like manner on a portion of a surface of the first substrate S1 containing the recess. The insulating layer D is formed on the anode electrodes A1 and A2 and then the grids G5 and G6 are formed in a stripe-like manner on the insulating layer D. The grids G5 and G6 and insulating layer D include recesses of substantially the same configuration as those of the first substrate S1. The recesses of the grids G5 and G6 and insulating layer D each are formed at a bottom portion thereof with openings Og and Od, respectively. The recesses Kg of the grids G5 and G6 each are formed on an inner periphery thereof with a tapered portion Tg. Likewise, the recess of the insulating layer D is formed with a tapered portion Ts in correspondence to the tapered portion Ts of the first substrate S1 in a manner like the tapered portion Tg of each of the grids G5 and G6. The anode electrodes A1 and A2 have the phosphors H51, H52 and H61 deposited on portions thereof exposed through the openings Og and Od of the grids G5 and G6 and insulating layer D.

In FIGS. 7(*a*) and 7(*b*), the phosphors H51, H52 and H61 are formed into substantially the same height as the grids G5 and G6, so that electrons emitted from the filaments may be concentrated on the phosphors H51, H52 and H61. This reduces accumulation of charges on the insulating layer D, to thereby minimize an electron eclipsing or shading phenomenon.

In FIGS. 7(*a*) and 7(*b*), as described above, the phosphors H51, H52 and H61 are formed into substantially the same height as the grids G5 and G6. Alternatively, the phosphors H51, H52 and H61 may be formed into a height larger than the grids G5 and G6. Such arrangement of the phosphors permits electrons emitted from the filaments to be further concentrated on the phosphors H51, H52 and H61, to thereby further reduce accumulation of electrons or charges on the insulating layer D.

In addition, as described above, the grids G5 and G6 each are formed with the recess Kg including the tapered portion Tg, to thereby enhance cut-off characteristics thereof and reduce an area of the insulating layer D exposed, leading to a further reduction in accumulation of electrons on the insulating layer D.

Also, in the illustrated embodiment, the insulating layer D is configured in the form of a thin film, to thereby permit a thickness thereof to be one tenth as large as that of the conventional thick-film insulating layer or less, resulting in further reducing accumulation of charges on the insulating layer.

Furthermore, in the illustrated embodiment, a thickness of each of the anode electrode, grid and insulating layer and a depth of each of the recesses of the first substrate S1 may be suitably determined, to thereby set each of the grids and phosphors at any desired height or level. Adjustment of a height of each of the grids and phosphors is varied depending on a depth of each of the recesses of the first substrate S1. Thus, although the tapered portion Ts of the recess of the first substrate S1 does not substantially affect adjustment of the height, it is desirably formed in order to enhance cut-off characteristics of the grids and a reduction in accumulation of charges on the insulating layer D.

Moreover, in the illustrated embodiment, the recesses of the first substrate S1 each are arranged at each of the intersections between the grids and the anode electrodes and formed into a rectangular or square shape. Alternatively, the recesses each may be configured in the form of a stripe-like groove for every stripe-like anode electrode. In this instance, the recess Kg of each of the grids is so constructed that a side thereof perpendicular to the anode electrode is removed or formed into a height smaller than the phosphor, to thereby be kept from causing any practical problem although it somewhat deteriorates cut-off characteristics of the grid.

Figure 8A:
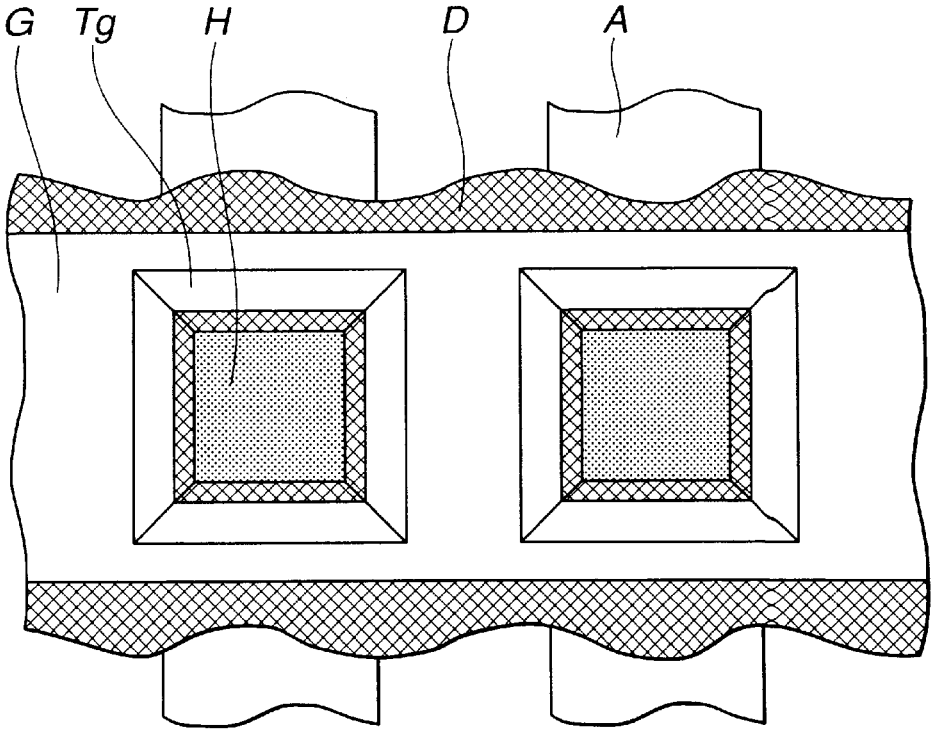
FIGS. 8(*a*) and 8(*b*) each are a fragmentary enlarged view of the first substrate shown in FIG. 6.
Figure 8B:
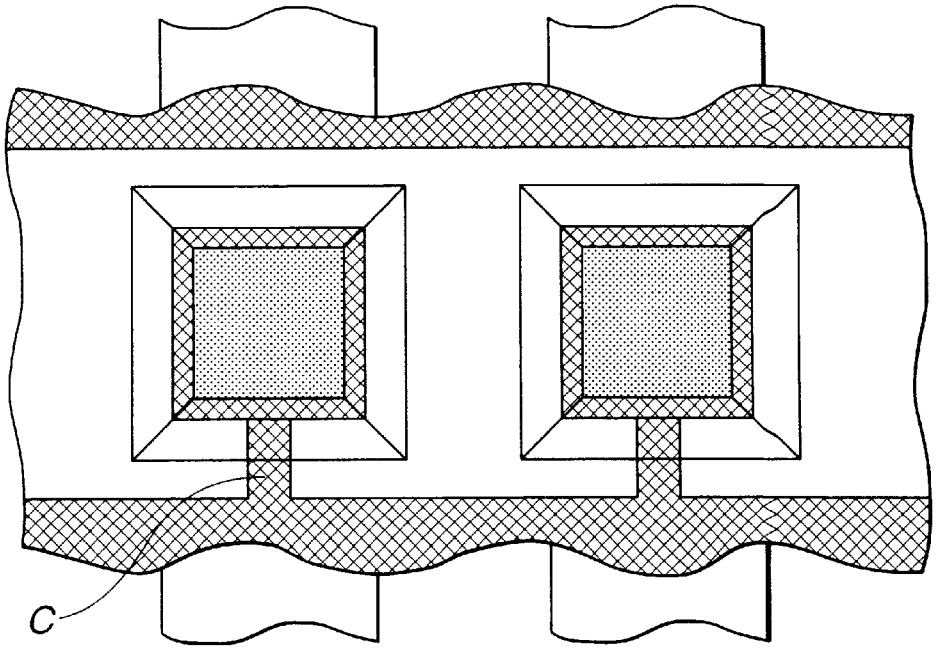

A modification of the recess of the grid will be described with reference to FIGS. 8(*a*) and 8(*b*). In FIGS. 8(*a*) and 8(*b*), reference character A designates the anode electrodes, D is the insulating layer, G is the grids, Tg is a tapered portion of each of recesses of the grids, and H is the phosphors. The phosphors H each are arranged in an opening of each of the recesses of the grids G and insulating layer D. In FIG. 8(*a*), the recess of the grid G is formed into a square configuration as in FIG. 6, whereas in FIG. 8(*b*), the recess of a square shape is formed at a part thereof with a cutout C. The cutout C may be formed so as to extend all over one side of the square recess. Alternatively, the cutout may be formed on each of both upper and lower sides of the square recess.

In FIG. 8(*a*), the openings of the recesses of the grid G are formed by photolithography. In FIG. 8(*b*), a mask for deposition or a deposition mask may be provided with bridges using the cutouts C, so that the openings may be formed by mask deposition concurrently with formation of the grid G.

In FIGS. 6 to 8(*b*), the openings of the grid and insulating layer and therefore a configuration of the phosphors are formed into a substantially square or rectangular shape. Alternatively, they may be formed into any other suitable configuration such as, for example, a polygonal shape, a circular shape or the like.

The insulating layer shown in FIGS. 7(*a*) to 8(*b*) is constructed so as to exhibit a black matrix function as well. This results in eliminating a necessity of arranging a black matrix separately.

Also, the construction of the first substrate S1 described above with reference to FIGS. 6 to 8(*b*) may be combined with back electrodes incorporated in the first embodiment of the present invention and described hereinafter with reference to FIGS. 12(*a*) to 13(*b*). Such combination permits the back electrodes to help an electron control function of the grids even when the grids are formed into a height substantially identical with or smaller than that of the phosphors H11 to H7n. Thus, the back electrodes and grids may cooperate with each other to positively control electrons emitted from the filaments toward the anode electrodes.

Now, formation of the first substrate S1, anode electrodes and the like shown in FIGS. 6 to 8(*b*) will be described with reference to FIG. 9.

Figure 9:
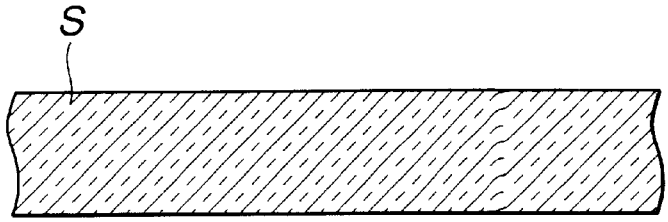
FIG. 9 is a fragmentary sectional view showing each of steps in manufacturing of the first substrate shown in FIG. 6.
Figure 9:
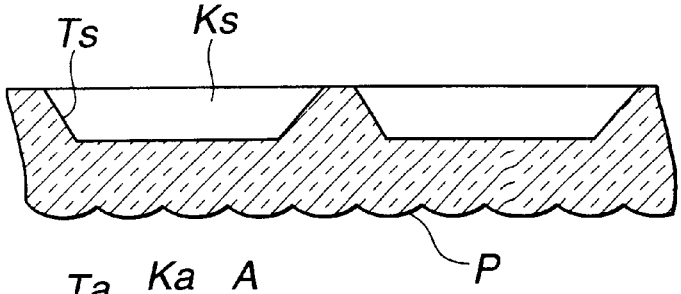
Figure 9:
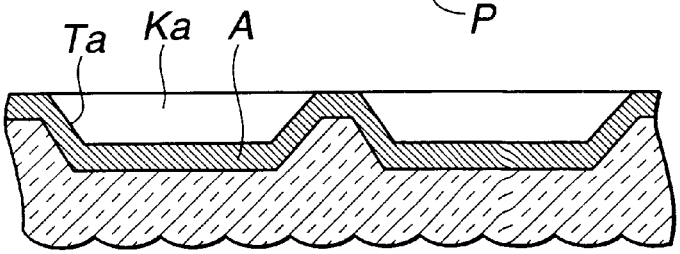
Figure 9:
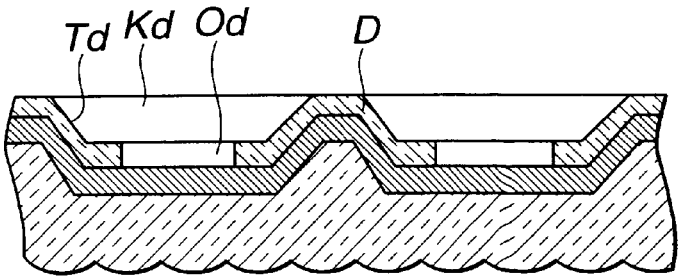
Figure 9:
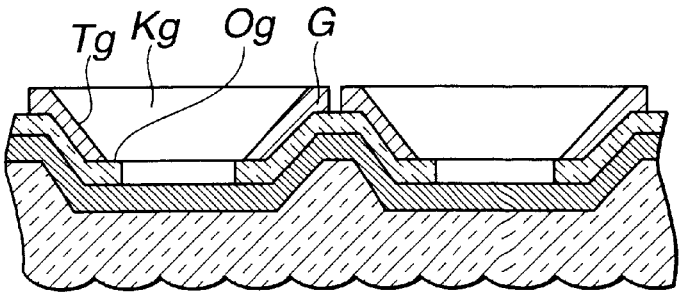
Figure 9:
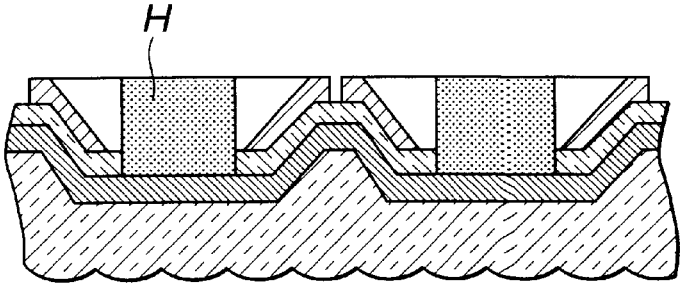

First of all, in a step (1) in FIG. 9, the glass substrate S of 1.1 mm in thickness is formed thereon with a resist pattern by photolithography. Then, in a step (2), the glass substrate S is formed on an upper surface thereof with the recesses Ks each including the tapered portion Ts using buffered hydrofluoric acid (BHF). Each of the recesses Ks is formed into a depth within a range of between several micrometers and tens of micrometers. In the illustrated embodiment, it is formed into a depth of 10 $\mu$m. Also, the tapered portion Ts is formed at an angle which permits rising by a distance of 10 $\mu$m with respect to a length of 10 $\mu$m in a horizontal direction. Also, the glass substrate S is so formed that a lower surface thereof opposite to that on which the recess Ks is formed is coarse as indicated at reference character P in the step (2) of FIG. 9. The coarse surface P acts as a non-reflective surface.

Then, in a step (3), a metal film for the anode electrodes is formed on the upper surface of the glass substrate S including the recesses Ks by subjecting metal such as ITO, Al or the like to sputtering, EB deposition or the like. Then, the metal film is subjected to patterning by photolithography, so that the stripe-like anode electrodes A are formed on the substrate S. Alternatively, use of a deposition mask permits formation of the anode electrodes A concurrent with formation of the metal film for the anode electrodes A. Reference character Ka designates the recess of the anode electrode and Ta is the tapered portion of the recess. The anode electrode A may be formed into a thickness within a range of between 0.1 $\mu$m and several micrometers. In the illustrated embodiment, it is set to be 0.5 $\mu$m. A thickness of the anode electrode A may be determined in view of resistivity of metal used for the anode electrode, a wiring pattern thereof, a depth of the recess Ks and the like. A material for the anode electrode may be selected from the group consisting of ITO, A1 and the like when the fluorescent display device is the direct observation type that luminescence of the phosphors is directly observed. Alternatively, it may be ITO when the fluorescent display device is the permeation type (FL type) that the luminescence is observed through the substrate S. The fluorescent display device of the direct observation type does not require formation of the coarse surface P.

Then, in a step (4), the anode electrodes are subjected to chemical vapor deposition (CVD) of silicon oxide (SiOx), to thereby be formed thereon with the thin-film insulating layer D. Then, the insulating layer D is subjected to chemical etching, RIE dry etching or the like, so that the recess Kd is formed with the opening Od. Reference character Td designates the tapered portion of the recess Kd. The opening Od permits the anode electrode A to be exposed therethrough. The insulating layer D may be formed into a thickness within a range of between 0.01 $\mu$m and several micrometers. In the illustrated embodiment, it is set to be 1.0 $\mu$m.

Then, a step (5) is executed. More specifically, an Al film is formed on the insulating layer D while covering each of the openings Od with a deposition mask, resulting in the grids G being formed. Kg designates each of the recesses of the grids G, Tg is the tapered portion of the recess, and Og is the opening. The girds G each are formed with the opening Og concurrently with formation of the grid. The grid may be formed into a thickness within a range of between 0.01 μm and tens of micrometers. In the illustrated embodiment, it is set to be 1.0 μm.

Thereafter, in a step (6), the anode electrodes A each are formed on a portion thereof exposed through each of the openings Od and Og of the insulating layer D and grid G with each of the phosphors H by slurry techniques.

Formation of the back electrodes may be carried out as in the first embodiment described above.

In the first and second embodiments described above, the stripe-like grids formed with the openings are arranged. Alternatively, in the present invention, stripe-like grids provided with no opening may be arranged as described below.

Figure 10A:
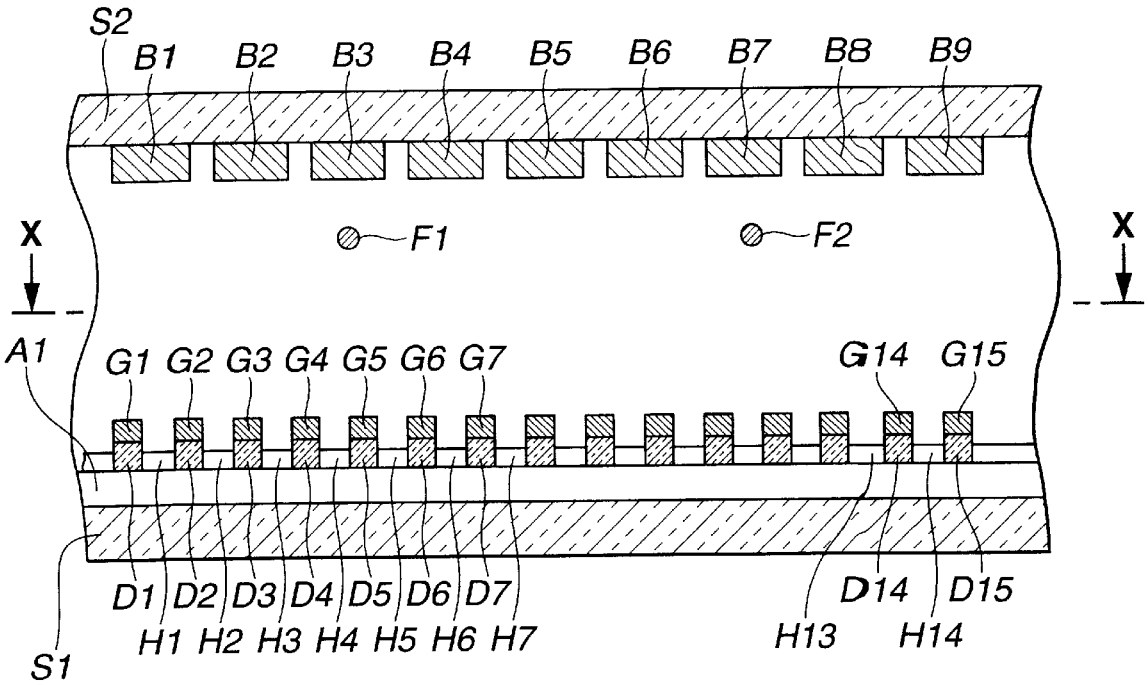
FIG. 10(*a*) is a fragmentary sectional view showing a third embodiment of a fluorescent display device according to the present invention.
Figure 10B:
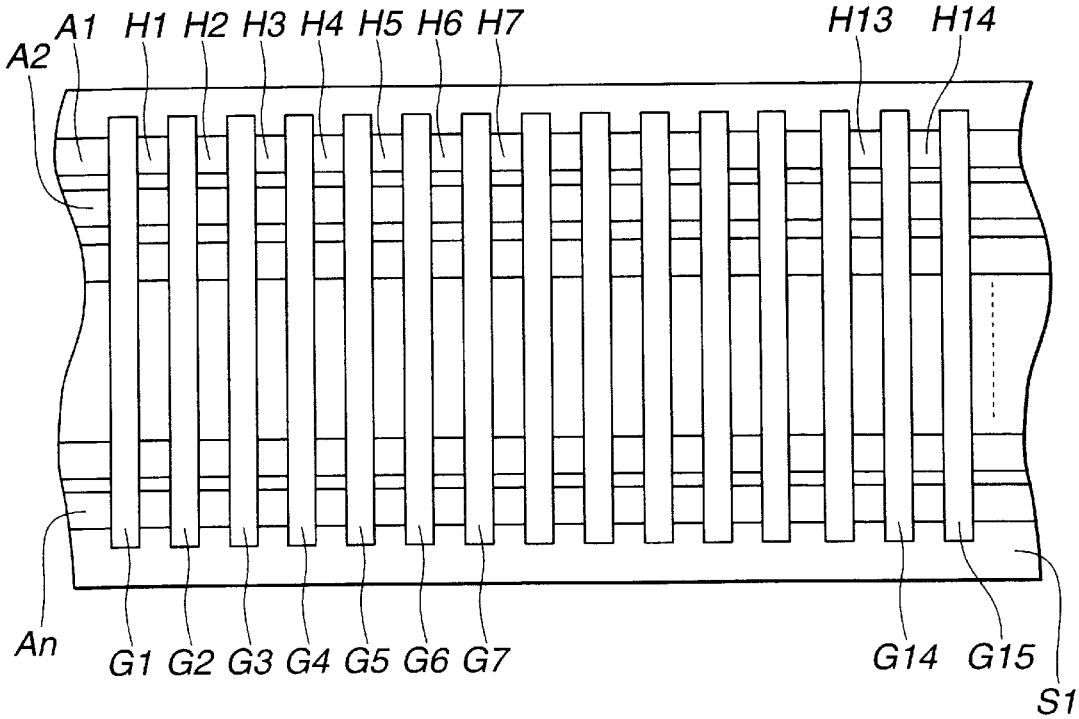
Figure 11A:
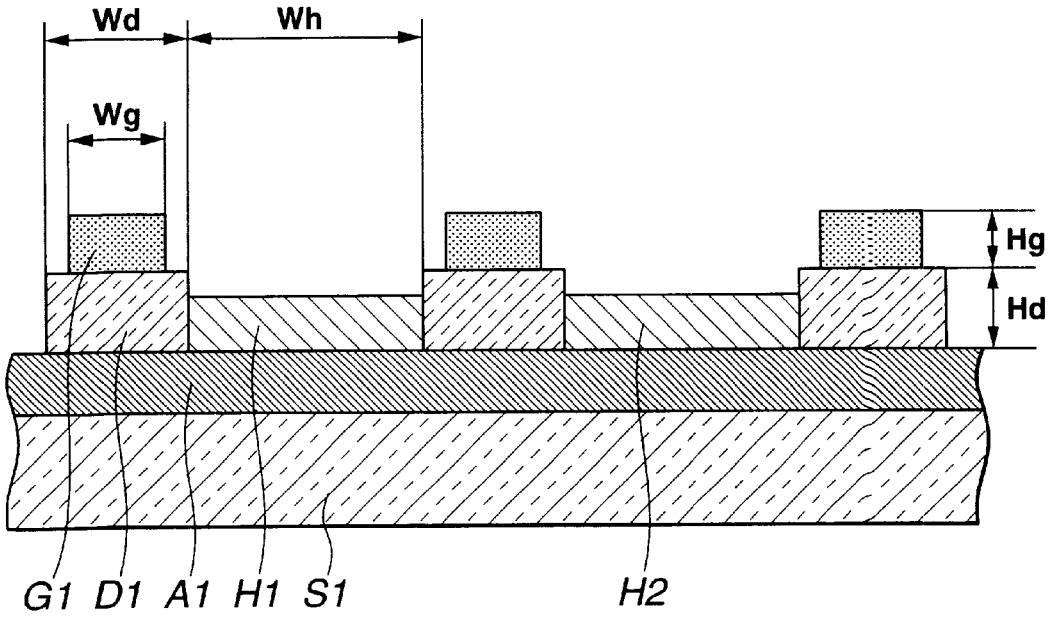
FIGS. 11(*a*) and 11(*b*) each are a fragmentary enlarged view showing an essential part of the fluorescent display device of FIGS. 10(*a*) and 10(*b*)
Figure 11B:
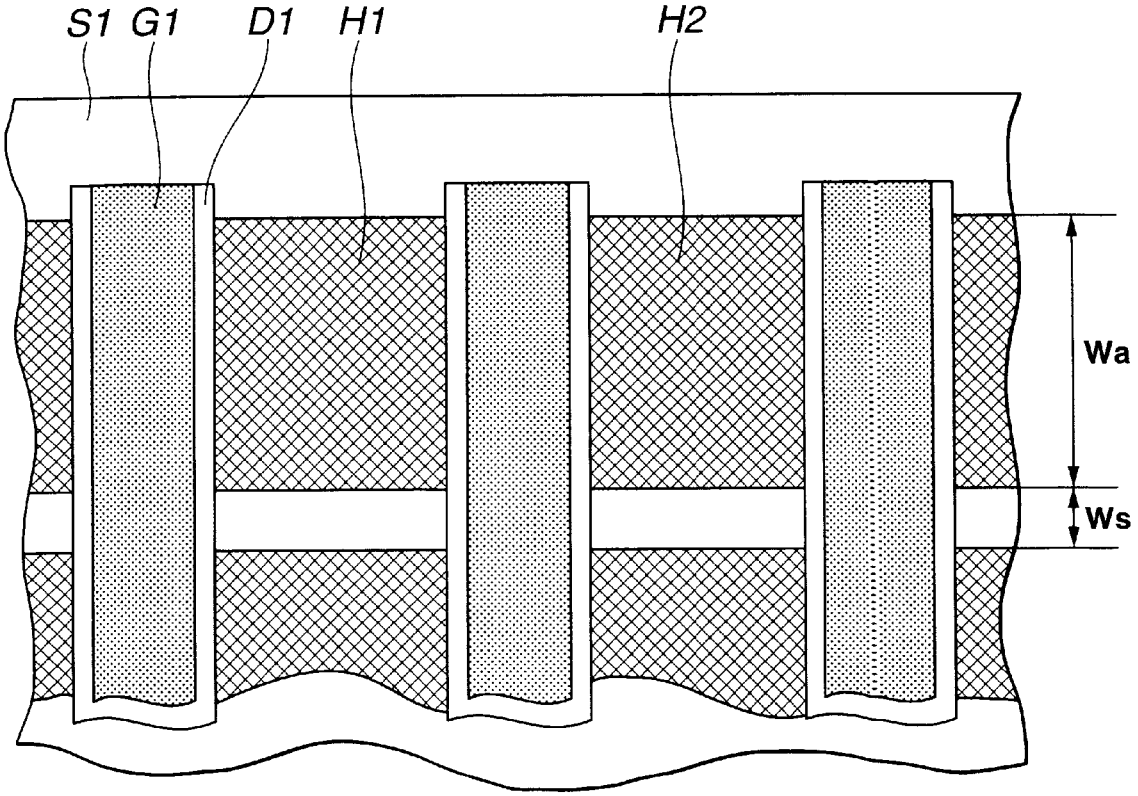

Referring now to FIGS. 10(*a*) to 11(*b*), a third embodiment of a fluorescent display device according to the present invention is illustrated, wherein FIG. 10(*a*) is a sectional view of the fluorescent display device, FIG. 10(*b*) is a plan view taken along line X—X of FIG. 10(*a*), and FIGS. 11(*a*) and 11(*b*) are enlarged views of FIGS. 10(*a*) and 10(*b*), respectively.

In FIGS. 10(*a*) to 11(*b*), S1 designates a first glass substrate, A1 to An each are a stripe-like anode electrode, H1 to H14 each are a phosphor, D1 to D15 each are a grid like a thin film, F1 and F2 each are a filament, B1 to B9 each are a back electrode, and S2 is a second glass substrate.

The grids G1 to Gn are formed into a width Wg of 100 μm, the insulating layers D1 to D15 are formed into a width Wd of 125 μm, an interval defined between each adjacent two of the insulating layers D1 to D15 is set to be 125 μm, the anode electrodes A1 to An are formed into a width of 125 μm and arranged so as to be spaced from each other at intervals Ws of 125 μm, the insulating layers D1 to D15 are formed into a thickness Hd of 1 μm, and the grids G1 to Gn are formed into a thickness Hg of 0.5 μm. The anode electrodes A1 to An are formed into a thickness of 0.15 μm and the phosphors H1 to H14 are formed into a thickness of several micrometers. In the illustrated embodiment, the phosphors H1 to H14 each have a thickness of 1.5 μm. Further, the filaments F1 and F2 are formed into a diameter of 30 μm. The thicknesses Hd and Hg of the insulating layers and grids each are preferably within a range of between 0.5 μm and tens of micrometers. More preferably, they are within a range of between 0.5 μm and several micrometers.

Now, manufacturing of the fluorescent display device of the illustrated embodiment will be described. First of all, the first glass substrate S1 is formed thereon with the thin filmlike anode electrodes A1 to An by forming a film of metal such as indium tin oxide (ITO), Al or the like by sputtering, deposition or the like. Then, the anode electrodes A1 to An are subjected to chemical etching or mask deposition, resulting in being patterned into a predetermined configuration. Then, the anode electrodes A1 to An are subjected to chemical vapor deposition (CVD) of silicon oxide (SiOx), silicon nitride (SiN) or the like, to thereby be formed thereon with the thin-film insulating layers D1 to D15. Then, the insulating layers D1 to D15 are subjected to chemical etching, RIE dry etching or the like, to thereby be formed with the openings, resulting in being patterned into a predetermined configuration. The insulating layers D1 to D15 are formed thereon with the thin film-like grids G1 to G15 by sputtering or EB deposition of metal such as ITO, Al or the like. Then, the grids G1 to G15 are subjected to dry etching or mask deposition, to thereby be patterned into a predetermined configuration. Thereafter, the anode electrodes A1 to An have a ZnO:Zn phosphor material deposited on each of portions thereof other than those on which the insulating layers D1 to D15 and grids G1 to G15 are formed by slurry techniques, leading to formation of the phosphors H1 to H14. Then, above the phosphors H1 to H14 are stretchedly arranged the filaments F1 and F2, which may be made of W or the like.

Subsequently, the second glass substrate S2 is formed thereon with the back electrodes B1 to B9 like a thin film according to a procedure like that for formation of the anode electrodes A1 to An described above. Lastly, the first substrate S1 and second substrate S2 are arranged so as to face each other and then the substrates and a side plate (not shown) are sealedly joined together to form an envelope, which is then evacuated, resulting in the fluorescent display device being provided.

The anode electrodes A1 to An and grids G1 to G5 are arranged in a matrix-like manner so as to intersect each other. The filaments F1 and F2 are stretchedly arranged so as to extend in a longitudinal direction of the grids G1 to G5 and the back electrodes B1 to B9 are formed in a stripe-like manner on the second substrate S2 and arranged so as to extend in a direction in which the filaments F1 and F2 are stretched.

In the illustrated embodiment, the anode electrodes, grids and back electrodes, as described above, are arranged directly on the substrates, so that only stretching of the filaments is required between both substrates, resulting in the fluorescent display device being simplified in structures.

Also, the insulating layers D1 to D15 on which the grids G1 to G15 are arranged each function as a black matrix as well, so that it is not required to arrange a black matrix separately.

Now, the manner of driving of the fluorescent display device of the first embodiment described above will be described with reference to FIGS. 12(*a*) and 12(*b*), wherein FIG. 12(*a*) is a sectional view showing the fluorescent display device including the first substrate S1 having the anode electrodes, insulating layer and grids arranged thereon and the second substrate S2 having the rear back electrodes B1 to B9 arranged thereon and FIG. 12(*b*) is a plan view taken along line A—A of FIG. 12(*a*).

The filaments F1 and F2 each acting as a cathode are stretchedly arranged so as to extend in the longitudinal direction of the grids G1 to G7. The back electrodes B1 to B9 are formed in a stripe-like manner and arranged so as to extend in the longitudinal direction of the filaments F1 and F2 and grids G1 to G7 or in a direction cross the anode electrodes.

First, operation of the back electrodes B1 to B9 will be described. The back electrodes B1 to B9 each have a control voltage within a range of between minus tens of volts and plus ten-odd volts applied thereto, to thereby control emission of electrons from the filaments F1 and F2 toward the anode electrodes A1 to An and interruption of the emission. In FIGS. 12(*a*) and 12(*b*), only the anode electrode A3 is shown for the sake of brevity. Of the back electrodes B1 to B9, the back electrodes B1 to B5 constitute a group for controlling the filament F1. Likewise, the back electrodes B6 to B9 constitute another group for controlling the filament F2. For example, when the filament F1 acts as an electron emission filament and the filament F2 acts as an electron emission interruption filament, the back electrodes B1 to B5 each have a positive control voltage which acts as a filament selection voltage applied thereto and the back electrodes B6 to B9 each have a negative control voltage which acts as a filament non-selection voltage applied thereto. Covering of the filament F2 with a negative potential keeps it from emitting electrons.

The filament selection voltage and filament non-section voltage are set to be between the filament potential (0V in the illustrated embodiment) and plus ten odd volts and between minus tens of volts and the filament potential (0V), respectively.

Now, by way of example, operation of the filament F1 and anode electrode A3 will be described supposing that the filament selection voltage applied to each of the back electrodes B1 to B9 is kept at the same level. The phosphors H23 and H33 positioned in proximity to the filament F1 and the phosphors H13 and H43 respectively positioned outside the phosphors H23 and H33 are different in distance to the filament F1 from each other, to thereby be different in the amount of electrons traveling thereto, leading to a difference in luminance therebetween.

In view of the above, the illustrated embodiment is so constructed that a potential gradient is given to the control voltages applied to the back electrodes B1 to B9, to thereby permit electrons emitted from the linear filaments to be substantially uniformly radiated in a plane-like manner to anode electrodes or phosphors.

Figure 12A:
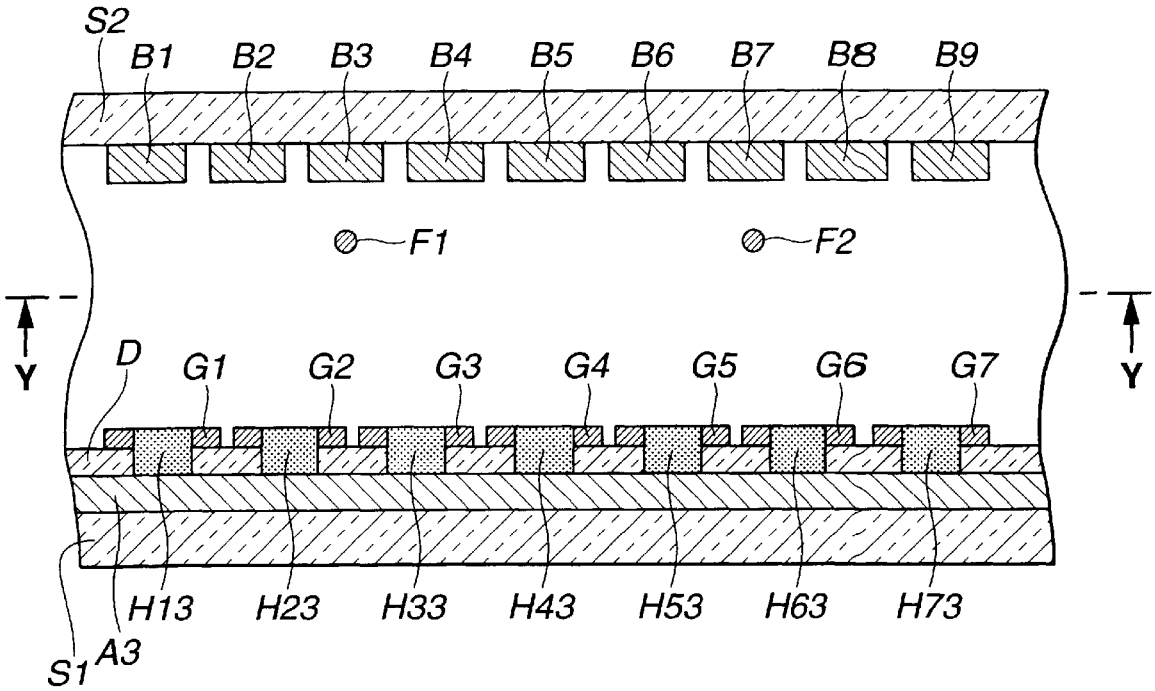
FIG. 12(*a*) is a fragmentary sectional view of a first embodiment of a fluorescent display device according to the present invention, which shows the manner of application of control voltages to back electrodes in the fluorescent display device.
Figure 12B:
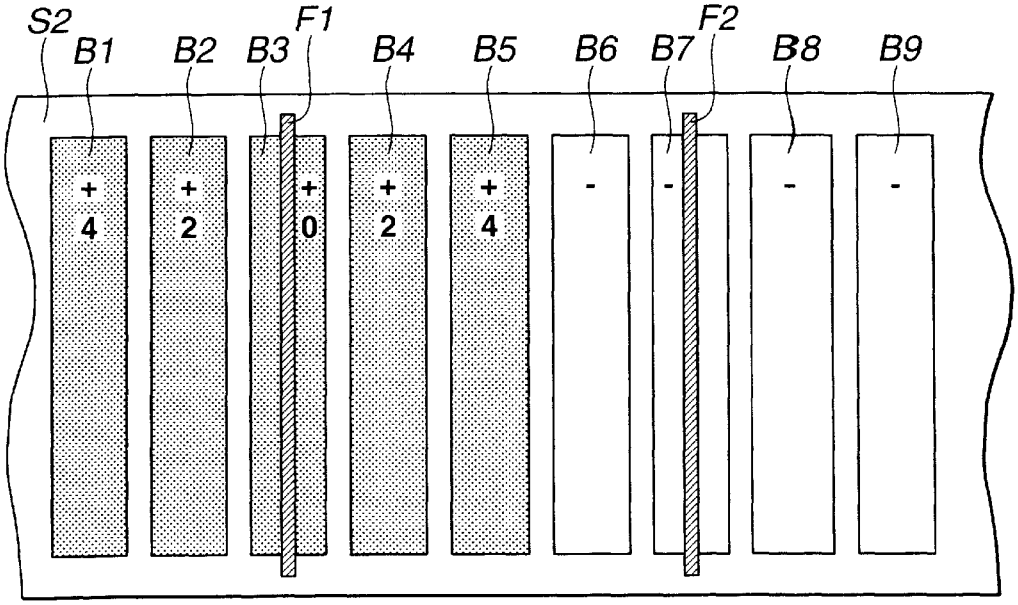

FIG. 12(*b*) shows a potential gradient given to control voltages applied to the back electrodes B1 to B9, wherein the filament F1 is selected.

In FIG. 12(*b*), the back electrode B3 nearest the filament F1 has a control voltage of 0V applied thereto, the back electrodes B2 and B4 arranged on both sides of the back electrode B3 each have a control voltage of 2V applied thereto, and the back electrodes B1 and B5 outside the back electrodes E2 and E4 each have a control voltage of 4V applied thereto. Such application of a potential gradient to the control voltages applied to the back electrodes permits electrons emitted from the filament to be uniformly spread or diffused in a plane-like manner to a region including both sides of the filament.

Arrangement of the back electrodes shown in FIGS. 12(*a*) and 12(*b*) may be applied to the conventional fluorescent display device.

Now, direct selection of the filaments in the fluorescent display device of the first embodiment will be described with reference to FIGS. 13(*a*) and 13(*b*), wherein FIG. 13(*a*) is similar to FIG. 12(*a*) and FIG. 13(*b*) is a plan view taken along line C—C of FIG. 13(*a*).

Figure 13A:
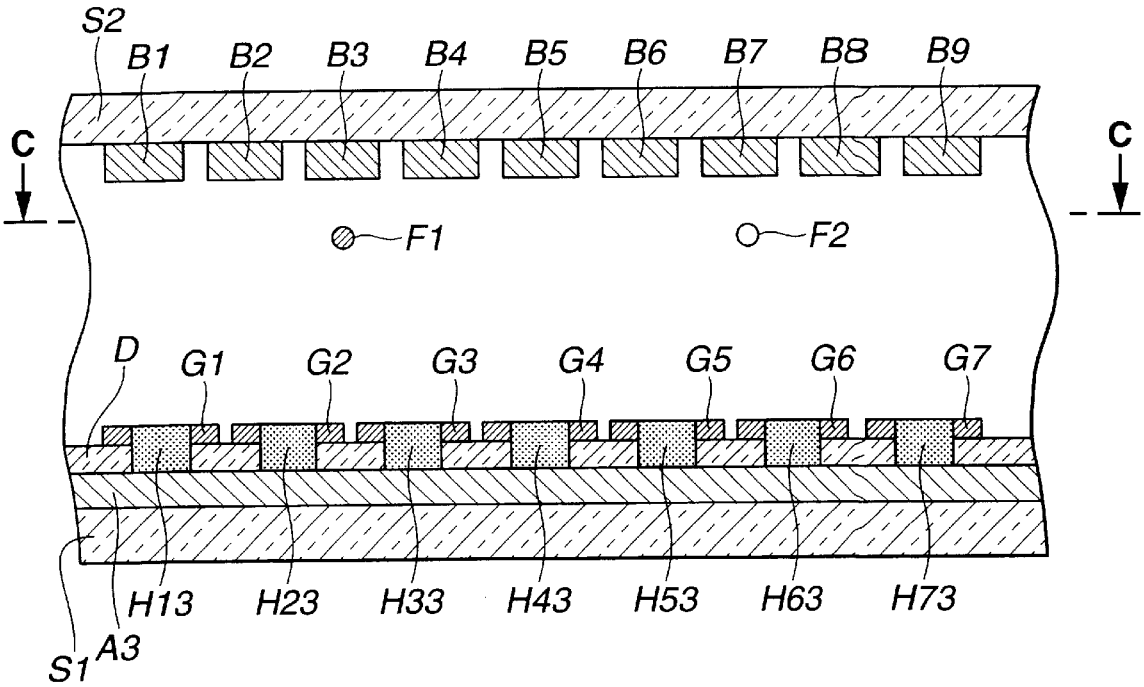
FIG. 13(*a*) is a fragmentary sectional view of a first embodiment of a fluorescent display device according to the present invention, which shows the manner of application of filament selection voltages to filaments in the fluorescent display device.
Figure 13B:
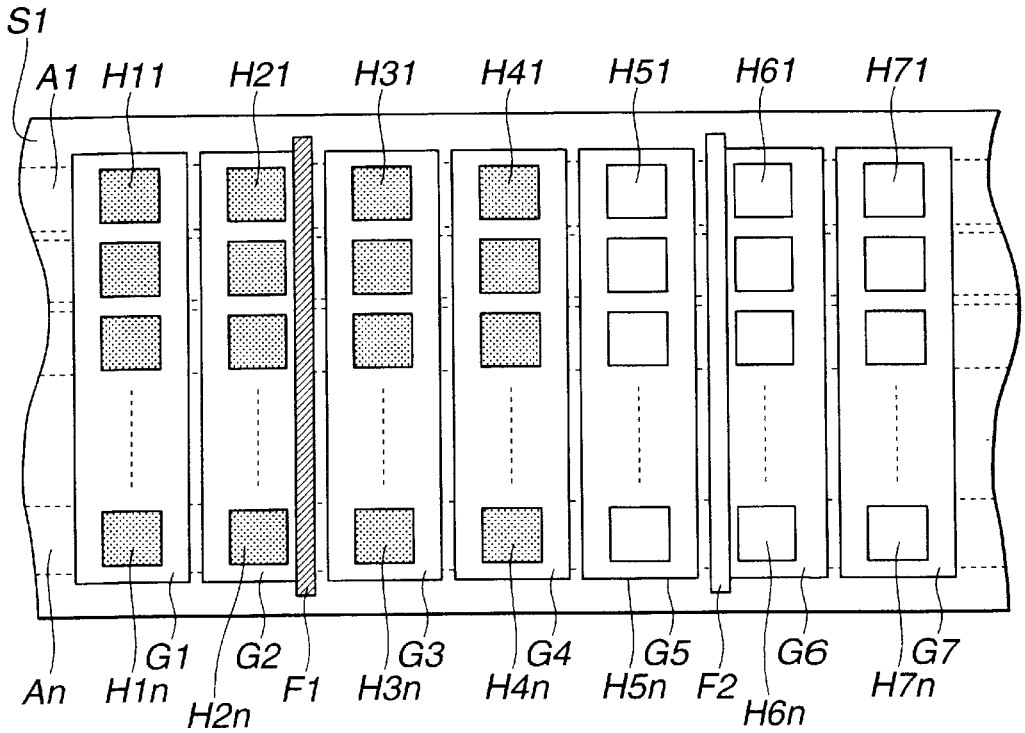

In FIGS. 13(*a*) and 13(*b*), the filament which is permitted to emit electrons is selected depending on polarity of voltages applied to the filaments. For example, when a negative filament selection voltage is applied to the filament F1 and a positive filament non-selection voltage is applied to the filament F2, the filament F1 is permitted to emit electrons due to a potential difference between the filament F1 and the grids (anode electrodes), and the filament F2 is kept from emitting electrons.

FIG. 13(*b*) shows application of a negative filament selection voltage to the filament F1 and application of a positive filament non-selection voltage to the filament F2. In this instance, the phosphors H11 to H4n are permitted to receive electrons emitted from the filament F1, to thereby be permitted to emit light, whereas the phosphors H51 to H7n are kept from receiving electrons from the filament F2, to thereby fail to emit light. Thus, application of a filament selection voltage to the filament F1 or F2 permits selective luminescence of the phosphors H11 to H7n.

In the illustrated embodiment, the phosphor H41 between the filaments F1 and F2 is located at a position which permit it to receive electrons from both filaments F1 and F2, so that overlap of a scan timing permits it to exhibit the same luminance as the phosphors at other positions, to thereby eliminate a difference in luminance between the phosphors.

Direct selection of the filaments shown in FIGS. 13(*a*) and 13(*b*) may be combined with application of control voltages having a potential gradient to the back electrodes shown in FIGS. 12(*a*) and 12(*b*). This more positively ensures selection of the filament and permits electrons emitted from the selected filament toward the anode electrodes to be uniformly diffused or spread in a plane-like manner.

Thus, in the illustrated embodiment, selection of the filament which is permitted to emit electrons is carried out depending on filament selection voltages applied to the back electrodes or filament selection voltages applied to the filaments and concurrently a potential gradient is given to the filament selection voltages. This results in electrons emitted from the filament selected being uniformly radiated to the anode electrodes.

Selection of the anode electrodes and grids is carried out by means of selection techniques used in the conventional fluorescent display device in which the anode electrodes and grids are arranged in a matrix-like manner. For example, the grids G1 to G7 each may have a voltage between minus tens of volts and plus tens of volts applied thereto in order by time division. More specifically, the grids selected each may have a voltage higher than a filament potential and lower an anode potential (for example, a voltage of plus several volts) applied thereto in order and the non-selected grids each may have a voltage equal to or lower than the filament potential (for example, a voltage of minus tens of volts) applied thereto in order. Also, the anode electrodes A1 to An each may be fed with a data signal of plus tens of volts. This permits predetermined phosphors of the phosphors H11 to H7n to be selected, leading to luminescence of the phosphors.

Figure 14:
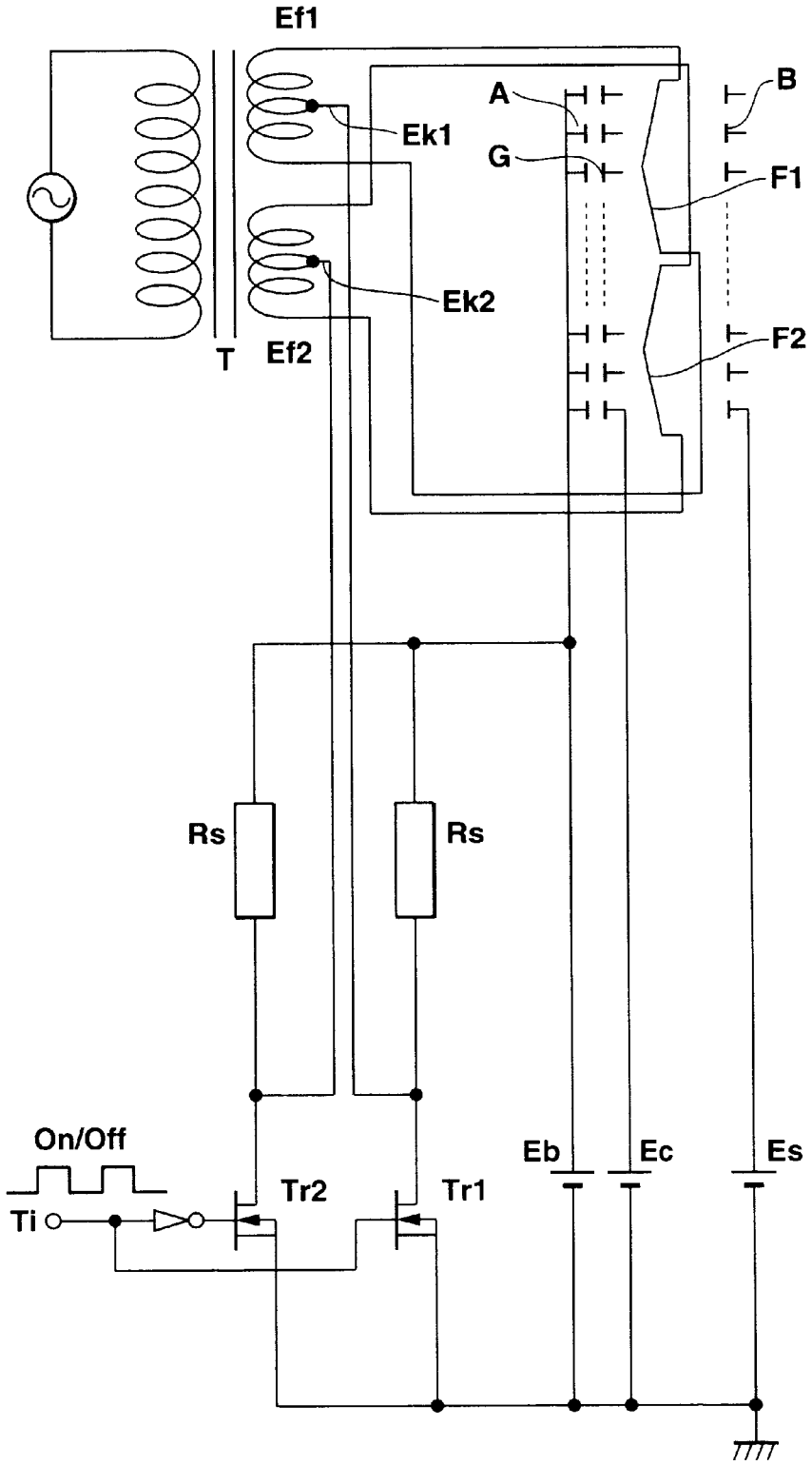
FIG. 14 is a circuit diagram showing a filament change-over circuit for a first embodiment of a fluorescent display device according to the present invention.

Now, a filament selection circuit which may be used for direct selection of the filaments shown in FIGS. 13(*a*) and 13(*b*) will be described with reference to FIG. 14 by way of example. In FIG. 14, for the sake of brevity, a circuit for each of the anode electrodes A, grids G and back electrodes B are schematically shown and a data write circuit, a grid scan circuit, a control voltage application circuit and the like are omitted.

The filament F1 and filament F2 have AC filament voltages applied thereto from secondary coils Ef1 and Ef2 of a transformer T, respectively.

The secondary coils Ef1 and Ef2 include central taps Ek1 and Ek2, respectively, which are connected through resistors Rs to a power supply Eb and grounded through switching elements Tr1 and Tr2. The switching element Tr1 is directly fed with an On/Off signal at an input terminal Ti and the switching element Tr2 is fed with the signal through a NOT circuit. When the signal at the input terminal Ti is an On signal, the switching element Tr1 is turned on to ground the central tap Ek1 of the secondary coil Ef1, to thereby permit a ground potential to be applied to the filament F1. Also, the switching element Tr2 is fed with an Off signal due to inversion of the On signal, to thereby be turned off. This results in the central tap Ek2 of the secondary coil Ef2 being connected to the power supply Eb, leading to application of a voltage from the power supply Eb to the filament F2. When the signal at the input terminal Ti is an Off signal, the switching elements Tr1 and Tr2 are as opposed to the above. This permits a ground potential to be applied to the filament F2 and a voltage to be applied to the filament F1 from the power supply Eb. Thus, it will be noted that continuous feeding of the On/Off signal to the input terminal Ti permits the filament F1 or F2 to be selected by time division.

The circuit for changing over or selecting the filaments is not limited to the structure shown in FIG. 14. Any suitable circuit may be employed for this purpose, so long as it permits a positive voltage and a negative voltage to be alternately applied to the filaments F1 and F2.

Figure 15:
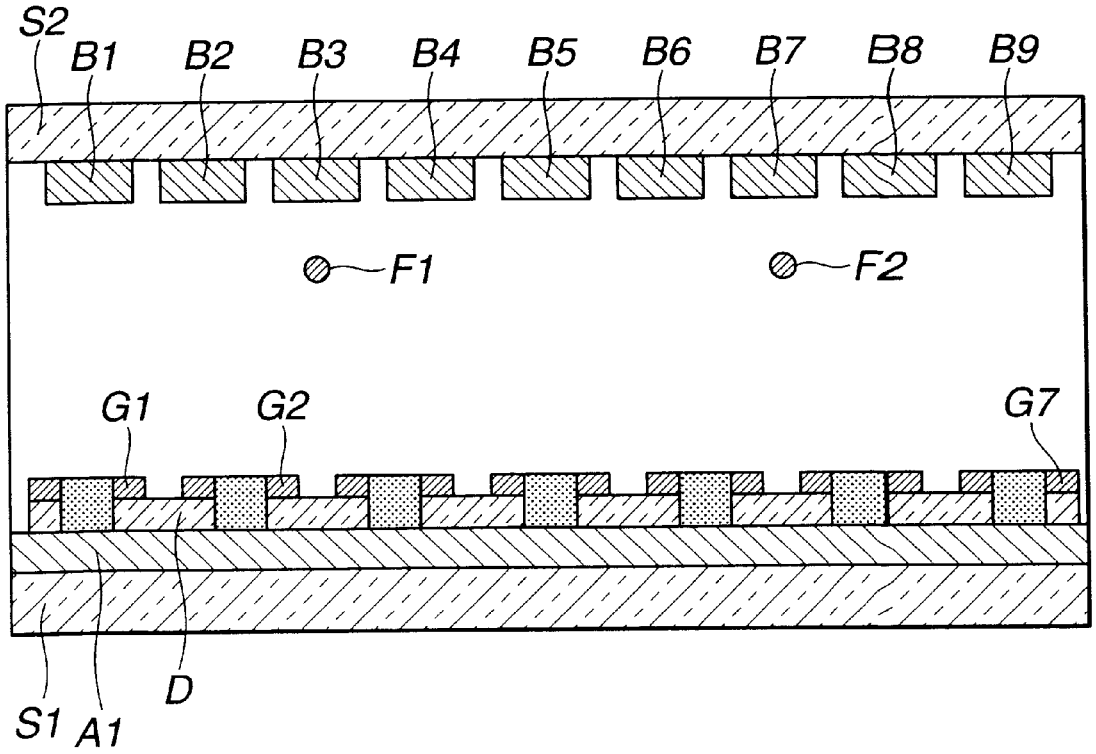
FIG. 15 is a sectional view showing a structure of a model fluorescent display device for electric field simulation relating to a first embodiment of a fluorescent display device according to the present invention.

Referring now to FIG. 15, a model fluorescent display device for electric field analysis simulation which was carried out for confirming an effect of a potential gradient given to the control voltages applied to the back electrodes incorporated in the fluorescent display device of the first embodiment described above is illustrated. The model fluorescent display device is constructed in substantially the same manner as that shown in FIGS. 12(*a*) to 13(*b*). More specifically, reference character S1 designates a first substrate, S2 is a second substrate, A1 is an anode electrode, G1 to G7 each are a grid, B1 to B9 each are a back electrode, F1 and F2 each are a filament, and D is an insulating layer.

In the model fluorescent display device thus constructed, the first substrate S1 and second substrate S2 are arranged so as to be spaced from each other at an interval of 0.86 mm, an interval between the back electrodes B1 to B9 and the filaments F1 and F2 is set to be 0.15 mm, an interval between the filaments F1 and F2 and the anode electrode A1 is 0.7 mm, an interval between the filament F1 and filament F2 is 2.0 mm, the anode electrode A1 has a voltage of 12.0V applied thereto, and the filaments F1 and F2 each have a voltage of 0V applied thereto. Of the grids G1 to G7, the grids selected each have a voltage of +6V applied thereto and the non-selected grids each have a voltage of −6V applied thereto.

Figure 16A:
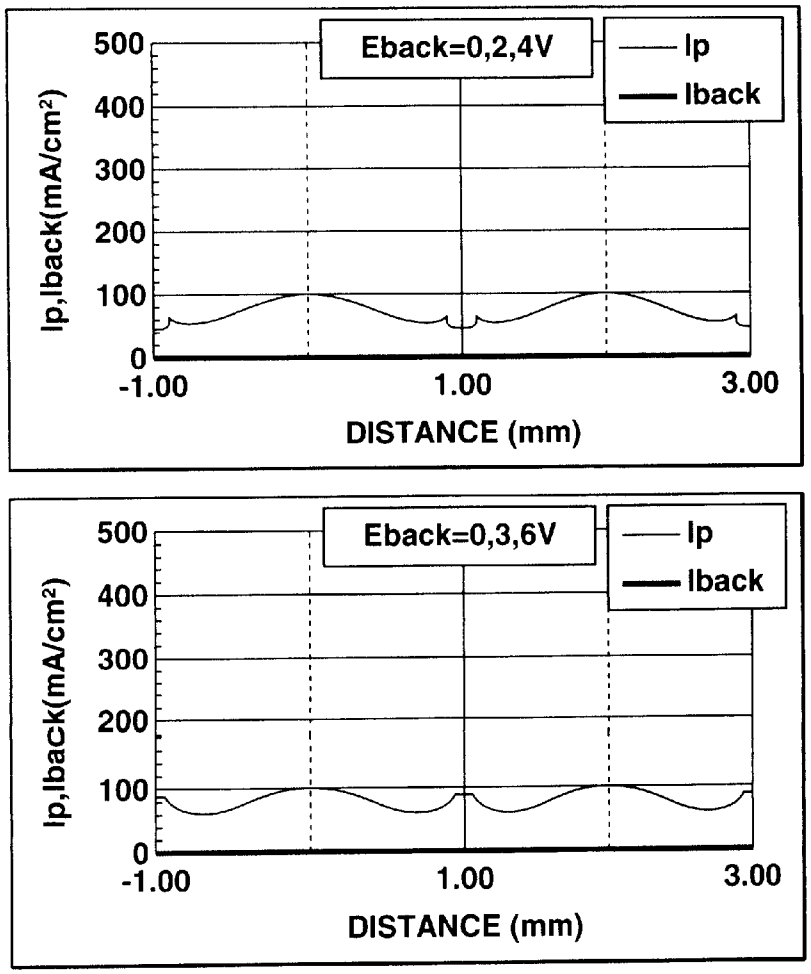
FIGS. 16(*a*) and 16(*b*) each are a diagrammatic view showing results of electric field analysis simulation relating to a first embodiment of a fluorescent display device according to the present invention.
Figure 16B:
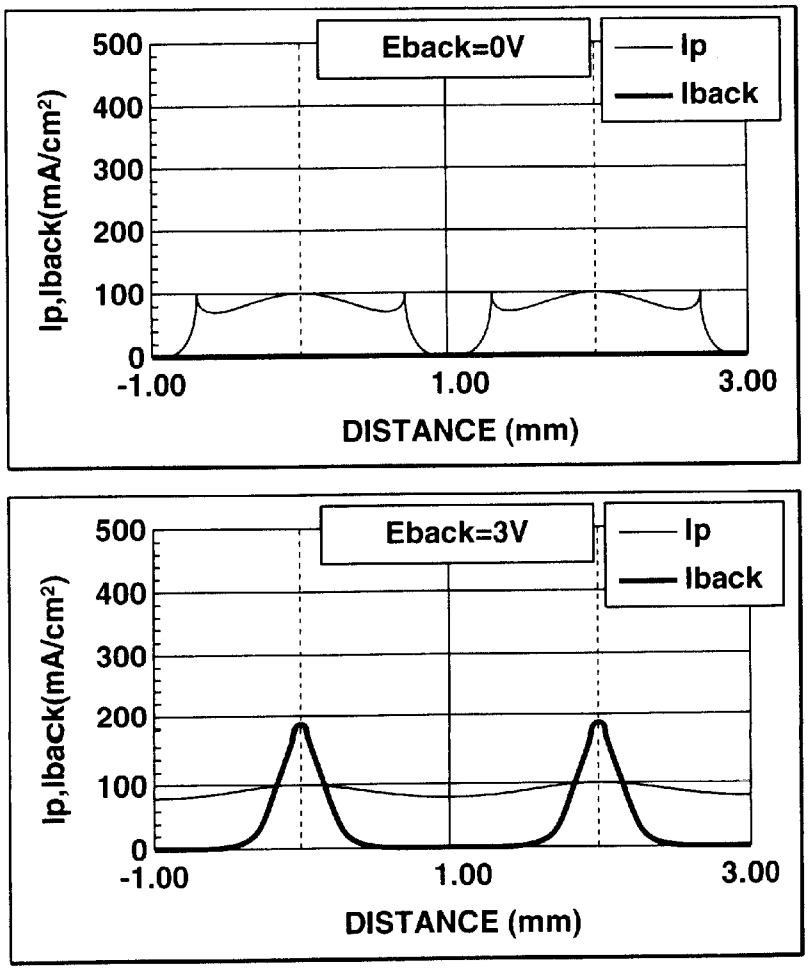

FIGS. 16(*a*) and 16(*b*) show results of simulation carried out by means of the model fluorescent display device described above with reference to FIG. 15 and indicate a variation in distribution of a current density of each of the anode electrode A1 and back electrodes B1 to B9 due to a difference among the control voltages applied to the back electrodes B1 to B9. FIG. 16(*a*) shows results obtained when a potential gradient is given to the control voltages applied to the back electrodes and FIG. 16(*b*) shows results obtained when a potential gradient is kept from being given to the control voltages. In FIGS. 16(*a*) and 16(*b*), an axis of ordinates indicates a distance in a lateral direction of the first substrate S1 shown in FIG. 15, wherein 1.00 corresponds to an intermediate position between the filament F1 and the filament F2, −1.00 corresponds to a left side end of the anode electrode A1 and 3.00 corresponds to a right side end thereof. An axis of abscissas indicates a current density (Ip) of the anode electrode A1 and a current density (Iback) of the back electrodes.

FIG. 16(*a*) indicates results of the simulation carried out for two control voltages (0V, 2V, 4V) and (0V, 3V, 6V) when a potential gradient is given to the control voltages (Eback) applied to the back electrodes B1 to B9. The back electrodes B3 and B7 each have a voltage of 0V applied thereto, the back electrodes B2, B4, B6 and B8 each have voltages of 2V and 3V applied thereto, and the back electrodes B1, B5 and B8 each have voltages of 4V and 6V applied thereto. FIG. 16(*b*) indicates results of the simulation made for two control voltages (Eback) of 0V and 3V when no potential gradient is given thereto.

FIG. 16(*a*) indicates that in each of the cases, the current density (Ip) is rendered substantially uniform near the filament and on both sides thereof, to thereby eliminate a current density (Iback) which does not contribute to luminescence. This permits luminance to be uniform throughout the anode electrode without causing a reactive current.

In FIG. 16(*b*), the control voltage (Eback) of 0V prevents the current density (Iback) from being a reactive current, however, it causes the current density (Ip) contributing to luminescence to be substantially extinguished at an intermediate between the filament F1 and the filament F2. This causes the phosphor of the anode electrode positionally corresponding to the intermediate to fail to emit light. When the control voltage (Eback) is 3V, the current density (Ip) contributing to luminescence is permitted to be substantially uniform over the whole anode electrode, however, the current density (Iback) forming a reactive current is caused to be increased in proximity to the filaments F1 and F2.

The results indicate that a potential gradient given to the control voltages permits electrons emitted from the filaments to be uniformly radiated to the whole anode electrode, to thereby render the current density equal over the whole anode electrode.

The control voltages of 0V, 2V, 4V, 3V, 6V and the like to which the potential gradient is given each may be fed by means of a power supply which generates each of the voltages. Alternatively, they may be fed by means of a voltage dividing circuit using a resistor or the like. Feeding of the voltages using a resistor may be carried out so that the back electrodes are varied in resistance depending on a configuration of the back electrodes or a material therefor.

The above-described simulation was carried out while keeping an interval between the filament F1 and F2 and the anode electrode A1 set at 0.7 mm. However, the interval may be set to be within a range of between 0.1 mm and several millimeters. In this instance, an increase in depth of a cut-off potential applied to the control electrode permits an increase in interval between the filaments and the anode electrode, however, the interval is more preferably set to be within a range of between about 0.5 mm and about 1.5 mm in view of dielectric strength of an IC for driving, a cost thereof and the like.

Driving of the fluorescent display device of the second embodiment described above may be carried out in substantially the same manner as driving of the fluorescent display device of the first illustrated embodiment described above with reference to FIGS. 12(*a*) to 16(*b*).

Now, the manner of driving of the fluorescent display device of the third embodiment described above will be described. First, operation of the back electrodes will be described.

The back electrodes B1 to B9 function to control emission of electrons from the filaments F1 and F2 toward the anode electrodes A1 to An and interruption of the emission. More specifically, the back electrodes B1 to B9 each have a control voltage which is constituted by a filament selection voltage and a filament non-selection voltage applied thereto, to thereby select the filament F1 or F2, leading to emission of electrons therefrom toward the anode electrodes. Considering the filament F1 and anode electrode A1 by way of example, the phosphor H4 nearest the filament F1 and the phosphors H1 to H3 and H5 to H7 positioned on both sides thereof are different in distance to the filament F1 from each other. This causes the amount of electrons radiated to the phosphor to be varied depending on a position of the phosphor, leading to a variation in luminance. In view of the problem, the illustrated embodiment is so constructed that a potential gradient is given to the control electrodes applied to the back electrodes B1 to B9, resulting in the electrons being substantially uniformly radiated to the anode electrodes in a plane-like manner.

In the fluorescent display device shown in FIG. 10, the grids are formed into a height larger than the anode electrodes or arranged in proximity to the filaments as compared with the anode electrodes. Alternatively, the grids may be formed into the same height as the anode electrodes or so as to be flush with the anode electrodes. When the grids are formed so as to be flush with the anode electrodes, the insulating layer is permitted to be relatively reduced in thickness. This reduces accumulation of charges on an exposed surface of the insulating layer and enhances controllability or cut-off characteristics.

The structure of the back electrodes shown in FIG. 10 may be applied to the conventional fluorescent display device.

Figure 17A:
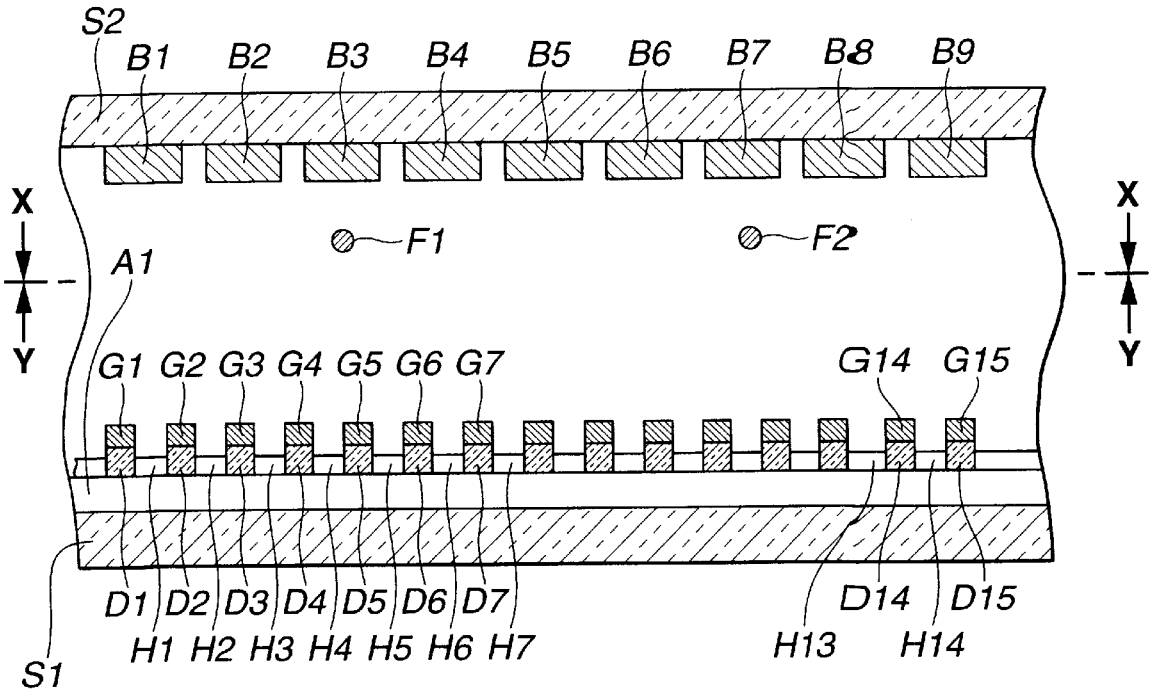
FIG. 17(*a*) is a fragmentary sectional view of a third embodiment of a fluorescent display device according to the present invention, which shows the manner of application of control voltages to back electrodes.
Figure 17B:
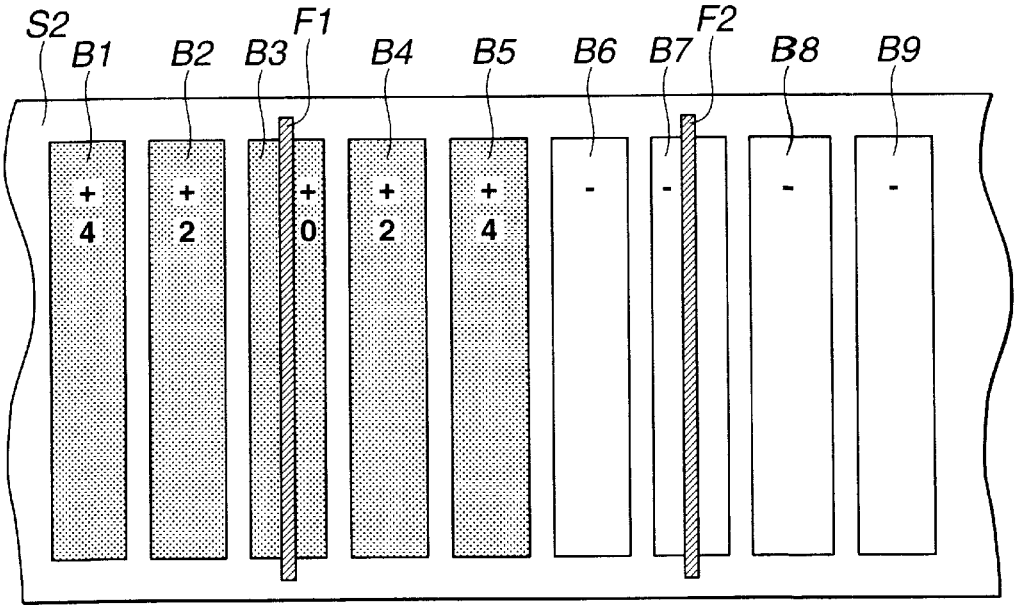
Figure 18:
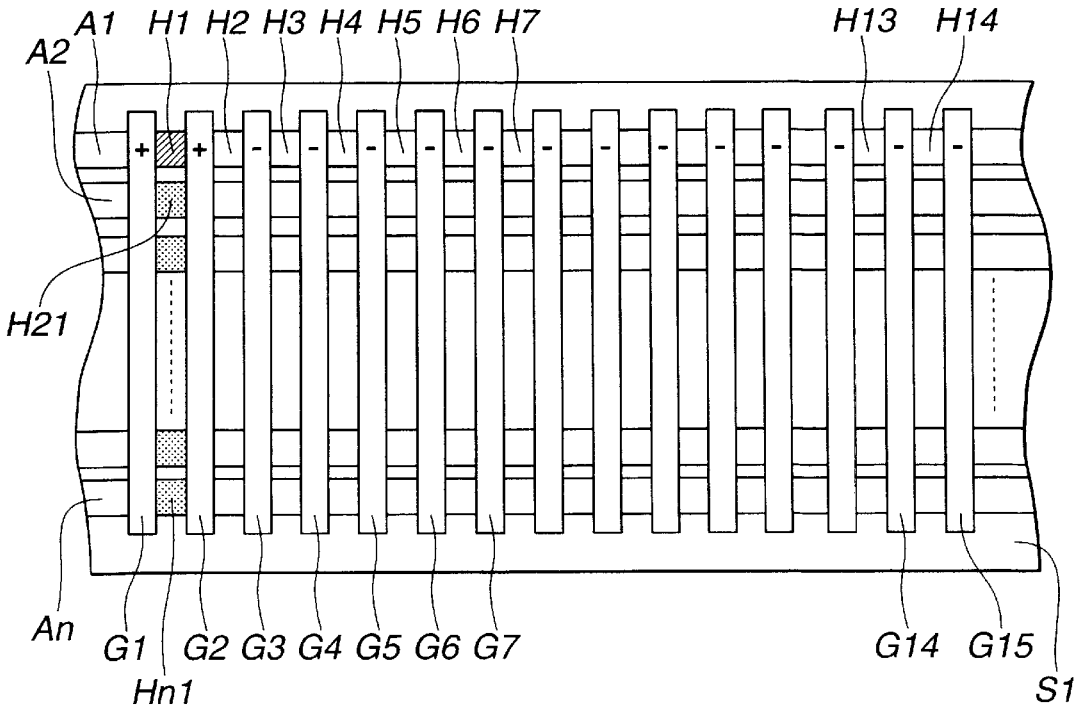
FIG. 18 is a sectional view taken along a line X—X of FIG. 17(*a*)

Now, the manner of application of a control voltage in the fluorescent display device of the third embodiment will be described with reference to FIGS. 17(*a*) to 18, wherein FIG. 17(*a*) is a sectional view of the fluorescent display device, FIG. 17(*b*) is a plan view taken along line Y—Y of FIG. 17(*a*) and FIG. 18 is a plan view taken along line X—X of FIG. 17(*a*).

First, application of control voltages to the back electrodes will be described. The back electrodes B1 to B9 each have a control electrode within a range of between minus tens of volts and plus ten-odd volts applied thereto, to thereby control emission of electrons from the filaments F1 or F2 and interruption of the emission. Of the back electrodes B1 to B9, the back electrodes B1 to B5 constitute a group for controlling the filament F1. Likewise, the back electrodes B6 to B9 constitute another group for controlling the filament F2. For example, when the filament F1 acts as an electron emission filament and the filament F2 acts as an electron emission interruption filament, the back electrodes B1 to B5 each have a positive control voltage which acts as a filament selection voltage applied thereto and the back electrodes B6 to B9 each have a negative control voltage which acts as a filament non-selection voltage applied thereto. FIG. 17(*b*) shows such application of the control voltages. The filament selection voltage and filament non-section voltage are set to be between the filament potential (0V in the illustrated embodiment) and plus ten odd volts and between minus tens of volts and the filament potential (0V), respectively.

In FIG. 17(*b*), a potential gradient is given to back voltages applied to the back electrodes B1 to B5 in order to ensure that electrons emitted from the filaments F1 and F2 may be uniformly radiated to the anode electrodes A1 to An. For example, the back electrode B3 nearest the filament F1 has a voltage of 0V applied thereto and the back electrodes B2 and B4 positioned on both sides of the back electrode B3 each have a voltage of 2V applied thereto. Also, the back electrodes B1 and B5 arranged outside the back electrodes B2 and B4 each have a voltage of 4V applied thereto. Such a structure of the illustrated embodiment that a potential gradient is given to the control voltages applied to the back electrodes B1 to B5 permits electrons emitted from the linear filaments to be substantially uniformly radiated to the anode electrodes in a plane-like manner.

Now, selection of a luminous region of the anode electrode will be described.

Selection of a luminous region of the anode electrode may be carried out in various ways. By way of example, a dual wire grid system in which two grids adjacent to each other have a grid selection voltage applied thereto in order will be described with reference to FIG. 18. Two adjacent grids each have a grid selection voltage Vs (0V<Vs<tens of volts) applied thereto and other grids each have a grid non-selection voltage Vh (minus tens of volts≦Vh≦0V) applied thereto. For example, the grids G1 and G2 each have the grid selection voltage Vs applied thereto and the other grids each have the grid non-section voltage Vh applied thereto. This results in portions of the anode electrodes A1 to An interposed between the grid G1 and the grid G2 acting as luminous regions. Thus, for example, when data are written in the anode electrode A1, electrons are radiated to a portion of the anode electrode A1 interposed between the grid G1 and the grid G2, leading to luminescence of the phosphor H1. Also, when data are likewise written in the anode electrodes A2 to An, the phosphors deposited on portions of the anode electrodes interposed between the grid G1 and the grid G2 are excited for luminescence. Scanning of such adjacent grids is transferred from the combination of the grids G1 and G2, through that of the grids G2 and G3 and that of the grids G3 and G4 to that of the grids G4 and G5 in order. Also, the anode electrodes A1 to An have data written therein in order in synchronism with the scanning.

Now, the manner of application of a filament selection voltage to the filament in the fluorescent display device of the third embodiment will be described with reference to FIGS. 19(*a*) and 19(*b*), wherein FIG. 19(*a*) is a sectional view of the fluorescent display device and FIG. 19(*b*) is a plan view taken along line X—X of FIG. 19(*a*).

Figure 19A:
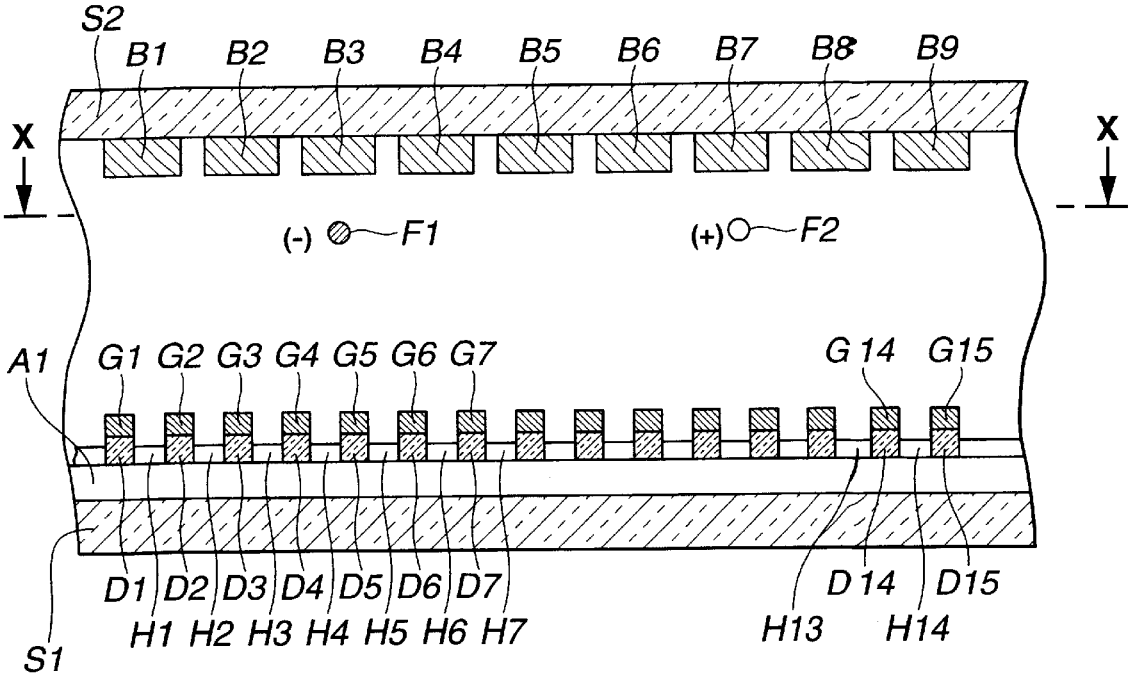
FIG. 19(*a*) is a fragmentary sectional view of a third embodiment of a fluorescent display device according to the present invention, which shows the manner of application of filament selection voltages to filaments.
Figure 19B:
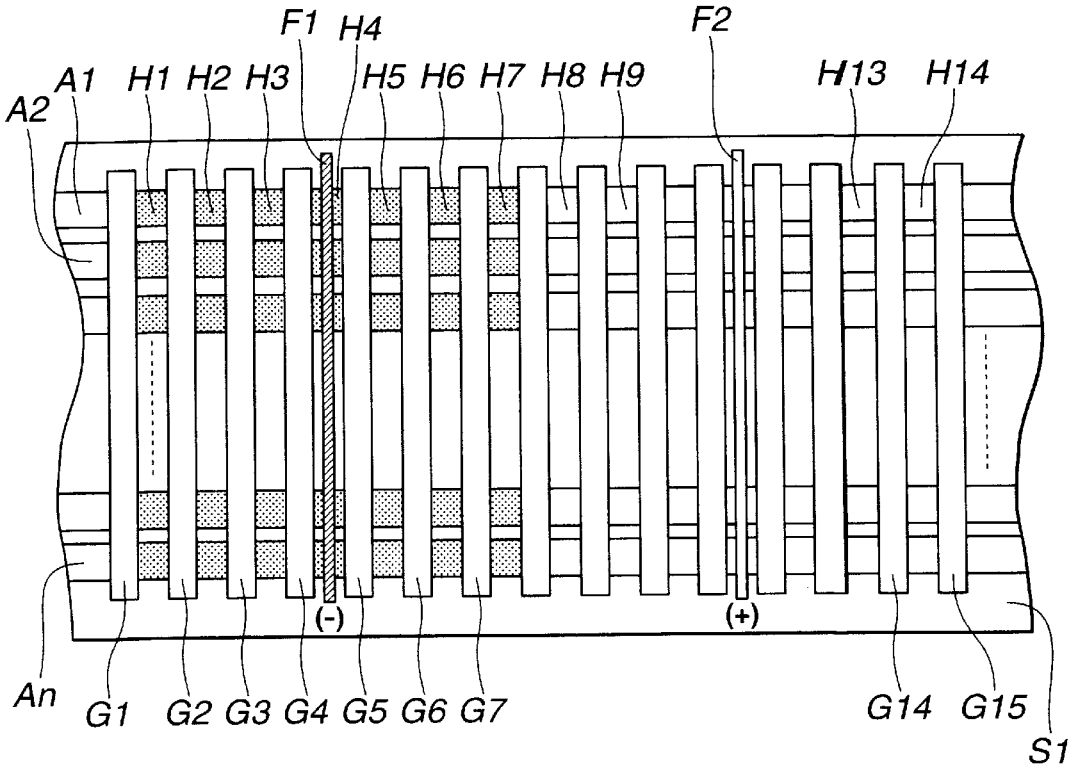

In FIGS. 19(*a*) and 19(*b*), the filament which is permitted to emit electrons is selected depending on polarity of a voltage applied to the filaments. For example, when a negative voltage is applied as a filament section voltage to the filament F1, the filament F1 is selected, to thereby be permitted to emit light. The filament F2 has a positive voltage applied thereto, to thereby be kept from being selected. This results in the filament F2 being placed in a state of electron emission interruption. In this instance, the phosphors H1 to H7 of the anode electrode A1 are permitted to have electrons radiated thereto and the phosphors H8 to H14 fail to have electrons radiated thereto. This is true of the anode electrodes A2 to An as well.

The back electrodes B1 to B9 constitute groups for controlling the filaments F1 and F2 as in FIGS. 17(*a*) to 18. Also, the manner of giving a potential gradient to the control voltages may be carried out as in FIGS. 17(*a*) to 18.

A circuit for selecting the filament F1 or F2 in the fluorescent display device of the third embodiment may be constructed in substantially the same manner as that in the first embodiment described above with reference to FIG. 14.

Figure 20:
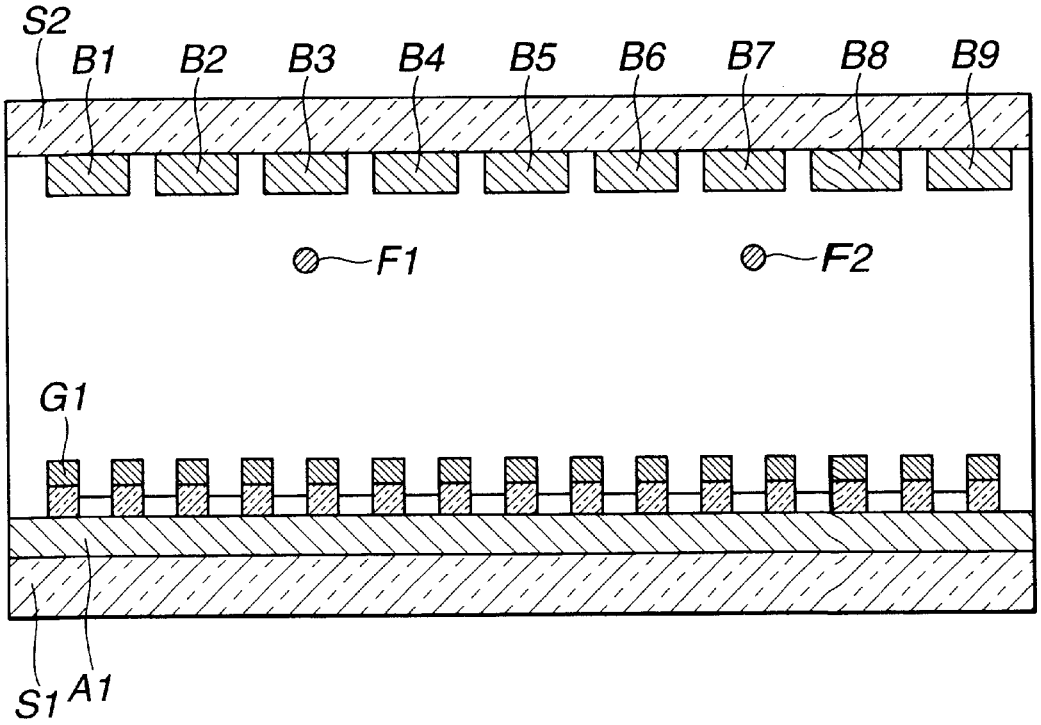
FIG. 20 is a sectional view showing a structure of a model fluorescent display device for electric field simulation relating to a third embodiment of a fluorescent display device according to the present invention.

Referring now to FIG. 20, a model fluorescent display device for electric field analysis simulation which was carried out for confirming an effect of a potential gradient given to control voltages in the third embodiment is illustrated. The model fluorescent display device may be constructed in substantially the same manner as that shown in FIG. 10. In the model fluorescent display device, a first substrate S1 and a second substrate S2 are arranged so as to be spaced from each other at an interval of 0.86 mm, an interval between back electrodes B1 to B9 and filaments F1 and F2 is set to be 0.15 mm, an interval between the filaments F1 and F2 and an anode electrode A1 is 0.7 mm, an interval between the filament F1 and the filament F2 is 2.0 mm, the anode electrode A1 has a voltage of 12.0V applied thereto, and the filaments F1 and F2 each have a voltage of 0V applied thereto.

Figure 21A:
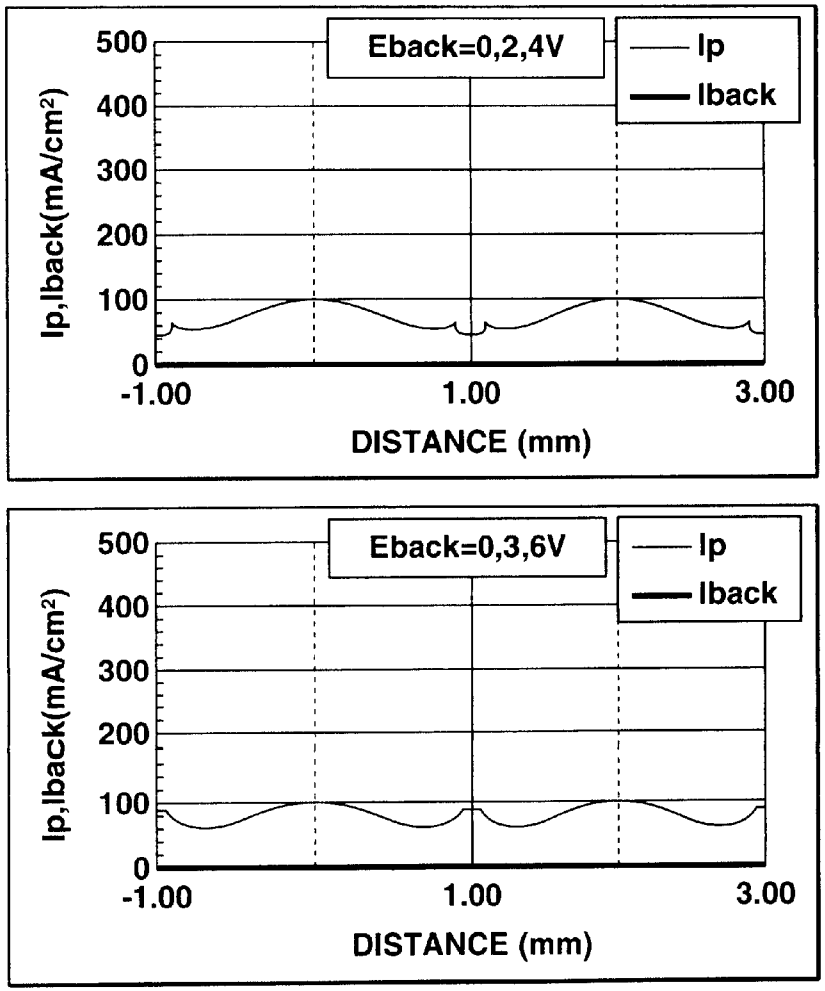
FIGS. 21(*a*) and 21(*b*) each are a diagrammatic view showing results of electric field analysis simulation relating to a third embodiment of a fluorescent display device according to the present invention.
Figure 21B:
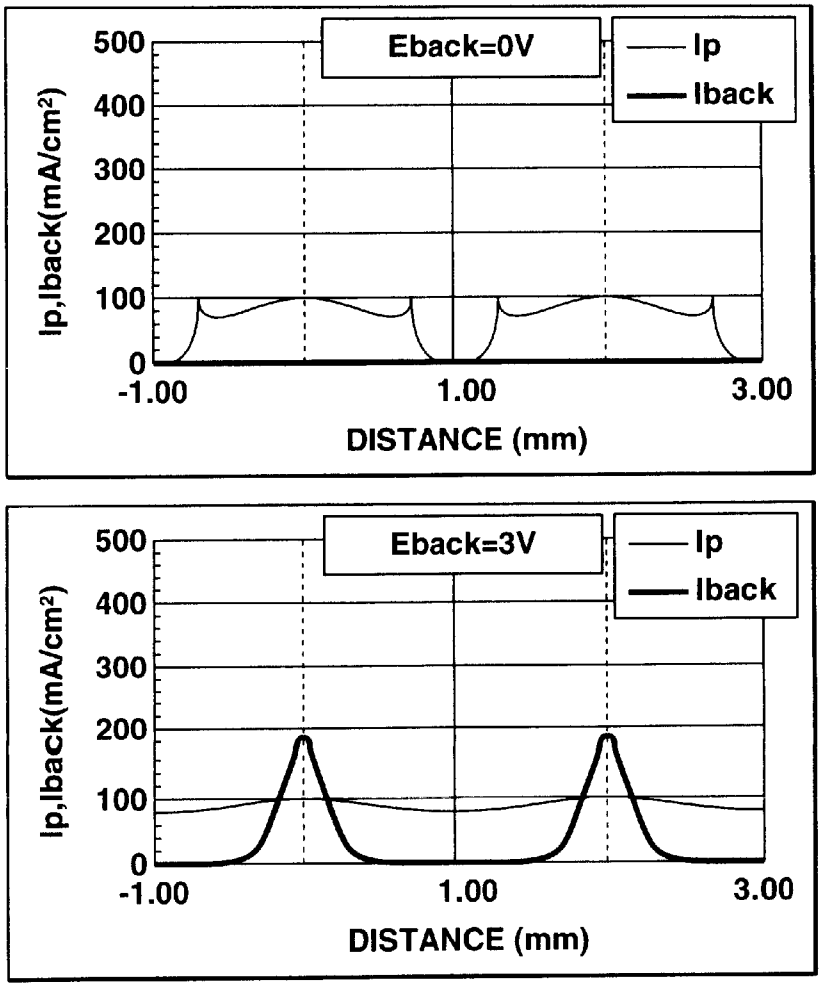
Figure 22A:
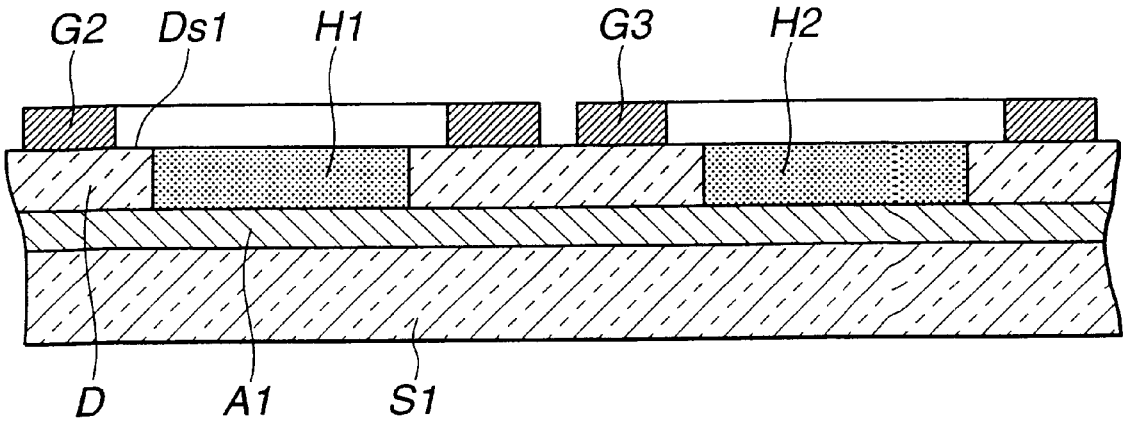
PRIOR ART FIG.22(a)
FIGS. 22(*a*) and 22(*b*) each are a fragmentary sectional view showing a conventional fluorescent display device.
Figure 22B:
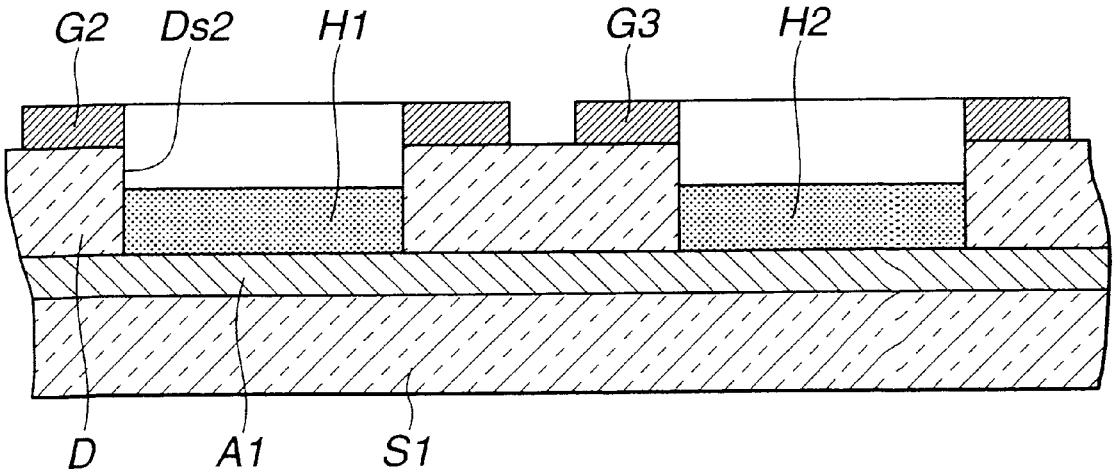
PRIOR ART FIG.22(b)

FIGS. 21(*a*) and 21(*b*) show results of the simulation by means of the model fluorescent display device shown in FIG. 20. FIG. 21(*a*) shows results obtained when a potential gradient is given to control voltages applied to the back electrodes B1 to B9 and FIG. 21(*b*) shows results obtained when a potential gradient is kept from being given to the control voltages. FIGS. 21(*a*) and 21(*b*) indicate substantially the same results as those shown in FIGS. 16(*a*) and 16(*b*).

As can be seen from the foregoing, the fluorescent display device of the present invention includes the back electrodes. The back electrodes help a function of the grids even when the grids are arranged at a position below the phosphors, so that electrons emitted from the filaments toward the anode electrodes may be smoothly and positively controlled.

Also, in the fluorescent display device of the present invention, the anode electrodes, insulating layers and grids each are made of a thin film and the grids each are formed with the opening so as to be positioned at substantially the same level as the phosphor or a level lower than the phosphor. Such configuration significantly reduces accumulation of electrons or charges on the insulating layer, to thereby substantially eliminate an electron eclipsing or shading phenomenon. Also, the insulating layer is formed of a thin film, so that a thickness of the insulating layer may be reduced to a level one tenth as large as a thickness of the conventional insulating layer or less, to thereby further enhance elimination of the accumulation.

Further, use of a thin film for formation of the anode electrodes, insulating layers and grids permits manufacturing of a fluorescent display device with high definition.

In addition, the fluorescent display device of the present invention includes the back electrodes, each of which is arranged on the side opposite to the anode electrodes with the filaments being interposed between the back electrodes and the anode electrodes. Such arrangement facilitates control of both emission of electrons from the filaments toward the anode electrodes and interruption of the emission. Also, a potential gradient is given to the control voltages, so that electrons emitted from the filaments toward the anode electrodes may be uniformly spread or diffused, resulting in realizing a plane-like electron source which renders an electron density substantially uniform.

Furthermore, the fluorescent display device of the present invention is so constructed that changing-over or selection between the filament of which electron emission is permitted and the filament of which electron emission is interrupted may be attained depending on a filament voltage applied to each of the filaments. This facilitates emission of electrons from the filament and interruption of the emission with increased reliability. Also, it ensures uniform electron emission by cooperation with an action of the back electrodes.

Also, the fluorescent display device of the present invention may be constructed in the manner that the substrate on which the anode electrodes, insulating layer, grids and phosphor layers are arranged is formed with the recesses, in which the phosphor layers are arranged. Thus, adjustment of a depth of the recesses permits a height of the phosphors to be set as desired.

Moreover, in the fluorescent display device of the present invention, the recesses each may be tapered, so that the recesses of the grids each may be tapered. This enhances cut-off characteristics of the grids and reduces an area of the insulating layer exposed through the recesses, leading to a reduction in accumulation of charges or electrons on the insulating layer.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising:

a first substrate;

stripe-like phosphor-deposited anode electrodes and stripe-like grids arranged in a matrix-like manner on said first substrate through an insulating layer;

said anode electrodes, grids and insulating layer each being made of a thin film;

a second substrate;

back electrodes each made of a thin film and arranged on said second substrate; and filaments stretchedly arranged between said first substrate and said second substrate.

2. A fluorescent display device comprising:

a first substrate;

stripe-like anode electrodes and stripe-like grids arranged in a matrix-like manner on said first substrate through an insulating layer;

said anode electrodes each having a phosphor deposited thereon;

said anode electrodes, grids and insulating layer each being made of a thin film;

a second substrate;

back electrodes each made of a thin film and arranged on said second substrate; and filaments stretchedly arranged between said first substrate and said second substrate;

said grids and insulating layer being formed at portions thereof positioned at intersections between said anode electrodes and said grids with openings;

said phosphor being deposited on a portion of said anode electrodes exposed through each of said openings.

3. A fluorescent display device comprising:

a first substrate;

stripe-like phosphor-deposited anode electrodes and stripe-like grids arranged in a matrix-like manner on said first substrate through an insulating layer;

a second substrate;

stripe-like back electrodes each arranged on said second substrate; and filaments stretchedly arranged between said first substrate and said second substrate so as to extend in a longitudinal direction of said back electrodes.

4. A fluorescent display device comprising:

a first substrate;

stripe-like anode electrodes and stripe-like grids arranged in a matrix-like manner on said first substrate through an insulating layer;

said anode electrodes each having a phosphor deposited thereon;

a second substrate;

stripe-like back electrodes arranged on said second substrate; and filaments stretchedly arranged between said first substrate and said second substrate so as to extend in a longitudinal direction of said back electrodes;

said grids and insulating layer being formed at portions thereof positioned at intersections between said anode electrodes and said grids with openings;

said phosphors each being deposited on a portion of said anode electrodes exposed through each of said openings.

5. A fluorescent display device as defined in claim 3 or 4, wherein said anode electrodes, grids, insulating layer and back electrodes each are formed in a manner like a thin film.

6. A fluorescent display device as defined in any one of claims 1 to 4, further comprising a means for giving a potential gradient to filament selection voltages applied to said back electrodes.

7. A fluorescent display device as defined in any one of claims 1 to 4, wherein said phosphors each have a surface arranged in proximity to said filaments as compared with a surface of said grids contiguous to said insulating layer.

8. A fluorescent display device as defined in claim 2 or 4, wherein said opening of each of said grids is formed with a cutout.

9. A fluorescent display device as defined in claim 2 or 4, wherein said first substrate is formed with recesses for receiving at least said phosphors therein, respectively.

10. A fluorescent display device as defined in claim 2 or 4, wherein said first substrate is formed with recesses for receiving at least said phosphors therein, respectively;

said recesses of said first substrate each being formed on an inner surface thereof with a tapered portion.

11. A fluorescent display device as defined in claim 2 or 4, wherein said first substrate is formed with recesses for receiving at least said phosphors therein, respectively; and said insulating layer and grids are formed with recesses each of which overlies an inner surface of each of said recesses of said first substrate.

12. A fluorescent display device as defined in claim 2 or 4, wherein said first substrate is formed with recesses for receiving at least said phosphors therein, respectively; and said insulating layer and grids are formed with recesses each of which overlies on an inner surface of each of said recesses of said first substrate;

said recesses of said grids each being formed on an inner surface thereof with a tapered portion.

13. A fluorescent display device as defined in claim 2 or 4, wherein said first substrate is formed with recesses for receiving at least said phosphors therein, respectively; and said first substrate is so formed that a surface thereof opposite to a surface thereof formed with said recesses is rough.

14. A method for driving a fluorescent display device as defined in any one of claims 1 to 4, wherein said back electrodes are classified into filament control groups;

said filament control groups having filament selection voltages and filament non-selection voltages applied thereto by time division, to thereby select the filament which is permitted to emit electrons.

15. A method for driving a fluorescent display device as defined in any one of claims 1 to 4, wherein said back electrodes are classified into filament control groups, which have filament selection voltages and filament non-selection voltages applied thereto by time division, to thereby select the filament which is permitted to emit electrons;

said filament selection voltages having a potential gradient given thereto.

16. A method for driving a fluorescent display device as defined in any one of claims 1 to 4, comprising the step of:

applying filament section voltages and filament non-selection voltages to said filaments by time division, to thereby select the filament which is permitted to emit electrons.

17. A method for driving a fluorescent display device as defined in any one of claims 1 to 4, comprising the steps of:

applying filament section voltages and filament non-selection voltages to said filaments by time division, to thereby select the filament which is permitted to emit electrons; and applying control voltages having a potential gradient given thereto to said back electrodes.

18. A method for driving a fluorescent display device as defined in any one of claims 1 to 4, comprising the step of:

applying grid selection voltages to said grids by time division by time division.

19. A method for driving a fluorescent display device as defined in any one of claims 1 to 4, comprising the step of:

applying grid selection voltages to said grids by time division by time division;

each adjacent two of said grids having grid selection voltages concurrently applied thereto.

20. A method for driving a fluorescent display device as defined in any one of claims 1 to 4, wherein said back electrodes are classified into filament control groups, which have filament selection voltages and filament non-selection voltages applied thereto by time division, to thereby select the filament which is permitted to emit electrons;

said filament selection voltages applied to each of said filament control groups having a potential gradient given thereto.

21. A method for driving a fluorescent display device as defined in any one of claims 1 to 4, comprising the step of:

applying grid selection voltages to said grids and inputting a data signal to said anode electrodes, to thereby select the phosphor which is permitted to emit light.

* * * * *